US008782941B2

(12) United States Patent
Zusman

(10) Patent No.: US 8,782,941 B2
(45) **Date of Patent: *Jul. 22, 2014**

(54) STOCK FOR A SMALL ARMS WEAPON

(76) Inventor: Nisim Zusman, Ein Ayala (IL)

( * ) Notice: Subject to any disclaimer, the term of this patent is extended or adjusted under 35 U.S.C. 154(b) by 231 days.

This patent is subject to a terminal disclaimer.

(21) Appl. No.: 13/174,766

(22) Filed: Jun. 30, 2011

(65) Prior Publication Data

US 2012/0000108 A1 Jan. 5, 2012

Related U.S. Application Data

(60) Provisional application No. 61/360,487, filed on Jun. 30, 2010, provisional application No. 61/417,950, filed on Nov. 30, 2010.

(51) Int. Cl.
*F41C 23/14* (2006.01)

(52) U.S. Cl.
USPC ..... 42/73; 42/74

(58) Field of Classification Search
USPC ..... 42/71.01, 73, 74
See application file for complete search history.

(56) References Cited

U.S. PATENT DOCUMENTS

| | | | |
|---|---|---|---|
| 294,402 | A | 3/1884 | Onderdonk |
| 319,613 | A | 6/1885 | Onderdonk |
| 436,997 | A | 9/1890 | Quackenbush |
| 746,859 | A | 12/1903 | Marble |
| 922,173 | A | 5/1909 | Lovelace |
| 931,328 | A | 8/1909 | Marble |
| 961,511 | A | 6/1910 | Marble |
| 1,051,960 | A | 2/1913 | Kennedy |
| 1,086,490 | A | 2/1914 | Weathers |
| 1,156,293 | A | 10/1915 | Jorgenson |
| 1,174,840 | A | 3/1916 | Fisher |
| 1,485,456 | A | 3/1924 | Von Frommer |
| 1,734,852 | A | 11/1929 | Frampton et al. |
| 1,822,875 | A | 9/1931 | Ammann |
| 2,098,139 | A | 11/1937 | Foley et al. |
| 2,400,422 | A | 5/1946 | Jonhson, Jr. |
| 2,433,151 | A | 12/1947 | Parsons |

(Continued)

FOREIGN PATENT DOCUMENTS

| | | |
|---|---|---|
| CN | 300736403 | 1/2008 |

OTHER PUBLICATIONS

U.S. Appl. No. 61/417,950, filed Nov. 30, 2010, Zusman.
U.S. Appl. No. 61/360,487, filed Jun. 30, 2010, Zusman.

(Continued)

*Primary Examiner* — J. Woodrow Eldred
(74) *Attorney, Agent, or Firm* — Law Office of Arthur M. Antonelli, PLLC

(57) ABSTRACT

A stock for a small arms weapon that includes a first member that includes a distal end which has a receiver extension connection structure, a proximal end, a first longitudinal axis extending between the proximal end and the distal end, and a first cross-sectional profile perpendicular to the first longitudinal axis which defines a maximum outer dimension of the stock. The stock further includes a second member connected to the first member which includes a third end adjacent to the proximal end, a fourth end spaced from the distal end, and a second longitudinal axis extending between the third end and the fourth end such that the first longitudinal axis and the second longitudinal axis are disposed at an acute angle. The stock further includes a chamber inside the second member that is sized and configured to house a power supply for a small arms accessory.

14 Claims, 20 Drawing Sheets

(56) References Cited

U.S. PATENT DOCUMENTS

| | | | |
|---|---|---|---|
| 2,766,542 | A | 10/1956 | Harvey |
| 3,044,204 | A | 7/1962 | Zimmerman |
| 3,348,328 | A | 10/1967 | Roy |
| 3,618,248 | A | 11/1971 | Into et al. |
| 3,618,249 | A | 11/1971 | Grandy |
| 4,141,166 | A | 2/1979 | Schultz |
| 4,271,623 | A | 6/1981 | Beretta |
| 4,327,626 | A | 5/1982 | McQueen |
| 4,512,101 | A | 4/1985 | Waterman, Jr. |
| 4,551,937 | A | 11/1985 | Seehase |
| 4,697,367 | A | 10/1987 | Brophy |
| 4,735,007 | A | 4/1988 | Gal |
| D324,557 | S | 3/1992 | Livingston |
| 5,209,215 | A | 5/1993 | Morrison |
| 5,225,613 | A | 7/1993 | Claridge |
| 5,622,000 | A | 4/1997 | Marlowe |
| 5,711,102 | A | 1/1998 | Plaster et al. |
| D391,334 | S | 2/1998 | Plaster et al. |
| 5,907,918 | A | 6/1999 | Langevin et al. |
| 6,598,329 | B1 | 7/2003 | Alexander |
| 6,598,330 | B2 | 7/2003 | Garrett et al. |
| 6,651,371 | B2 | 11/2003 | Fitzpatrick et al. |
| 6,779,289 | B2 | 8/2004 | Kay |
| 6,829,855 | B2 | 12/2004 | Seifert |
| 6,839,998 | B1 | 1/2005 | Armstrong |
| 6,874,267 | B2 | 4/2005 | Fitzpatrick et al. |
| 6,925,743 | B1 | 8/2005 | DiGiovanna |
| 7,104,001 | B1 | 9/2006 | Digiovanna |
| 7,131,228 | B2 | 11/2006 | Hochstrate et al. |
| 7,152,355 | B2 | 12/2006 | Fitzpatrick et al. |
| 7,162,822 | B1 | 1/2007 | Heayn et al. |
| 7,337,573 | B1 | 3/2008 | DiGiovanna |
| 7,398,616 | B1 | 7/2008 | Weir |
| 7,418,797 | B1 | 9/2008 | Crose |
| 7,428,794 | B2 | 9/2008 | Oz |
| D584,373 | S | 1/2009 | Young |
| D589,578 | S | 3/2009 | Choma |
| D600,308 | S | 9/2009 | Fitzpatrick et al. |
| 7,587,852 | B1 | 9/2009 | Harms |
| D603,013 | S | 10/2009 | Fitzpatrick et al. |
| D604,794 | S | 11/2009 | Bentley |
| 7,610,711 | B2 | 11/2009 | Oz |
| 7,627,975 | B1 | 12/2009 | Hines |
| 7,640,688 | B2 | 1/2010 | Oz |
| 7,647,719 | B2 | 1/2010 | Fitzpatrick et al. |
| 7,654,187 | B2 | 2/2010 | Hochstrate et al. |
| D616,056 | S | 5/2010 | Bentley |
| 7,743,544 | B2 | 6/2010 | Laney et al. |
| D620,067 | S | 7/2010 | Saur |
| 7,762,018 | B1 | 7/2010 | Fitzpatrick et al. |
| 7,775,150 | B2 | 8/2010 | Hochstrate et al. |
| 7,805,873 | B2 | 10/2010 | Bentley |
| 7,810,270 | B2 | 10/2010 | Fitzpatrick et al. |
| 7,823,313 | B2 | 11/2010 | Faifer |
| 7,827,722 | B1 | 11/2010 | Davies |
| 8,127,483 | B2 | 3/2012 | Kincel |
| 8,387,298 | B2 * | 3/2013 | Kincel ..... 42/74 |
| 2003/0110675 | A1 | 6/2003 | Garrett et al. |
| 2003/0196366 | A1 | 10/2003 | Beretta |
| 2003/0200693 | A1 | 10/2003 | Seifert |
| 2004/0016167 | A1 | 1/2004 | Fitzpatrick et al. |
| 2005/0108915 | A1 | 5/2005 | Kincel |
| 2005/0262752 | A1 | 12/2005 | Robinson et al. |
| 2006/0096146 | A1 | 5/2006 | Fitzpatrick et al. |
| 2006/0254414 | A1 | 11/2006 | Kuczynko et al. |
| 2007/0261284 | A1 | 11/2007 | Keng |
| 2008/0236016 | A1 | 10/2008 | Fitzpatrick et al. |
| 2008/0236017 | A1 | 10/2008 | Fitzpatrick et al. |
| 2008/0301994 | A1 | 12/2008 | Langevin et al. |
| 2009/0139128 | A1 | 6/2009 | Fluhr |
| 2009/0178325 | A1 | 7/2009 | Veilleux |
| 2009/0241397 | A1 | 10/2009 | Fitzpatrick et al. |
| 2009/0255161 | A1 | 10/2009 | Fitzpatrick et al. |
| 2010/0115817 | A1 | 5/2010 | Faifer |
| 2010/0180485 | A1 | 7/2010 | Cabahug et al. |
| 2010/0192444 | A1 | 8/2010 | Cabahug et al. |
| 2010/0192446 | A1 | 8/2010 | Darian |
| 2010/0192447 | A1 | 8/2010 | Cabahug et al. |
| 2010/0205846 | A1 | 8/2010 | Fitzpatrick et al. |
| 2010/0251591 | A1 | 10/2010 | Burt et al. |
| 2010/0275489 | A1 | 11/2010 | Cabahug et al. |
| 2010/0300277 | A1 | 12/2010 | Hochstrate et al. |
| 2011/0173863 | A1 * | 7/2011 | Ingram ..... 42/73 |
| 2012/0000109 | A1 | 1/2012 | Zusman |

OTHER PUBLICATIONS

U.S. Appl. No. 29/383,192, filed Jan. 13, 2011, Zusman.
U.S. Appl. No. 13/185,430, filed Jul. 18, 2011, Zusman.
Locarno (International Designs) search results, Jan. 10, 2011, pp. 1-16.

* cited by examiner

STOCK FOR A SMALL ARMS WEAPON

CROSS REFERENCE TO RELATED APPLICATIONS

This application claims the benefit of U.S. Provisional application No. 61/360,487 filed on Jun. 30, 2010. U.S. Provisional Application No. 61/360,487 is incorporated by reference herein in its entirety. This application claims the benefit of U.S. Provisional Application No. 61/417,950 filed on Nov. 30. 2010. U.S. Provisional Application No. 61/417,950 is incorporated by reference herein in its entirety. This application claims the benefit of U.S. application Ser. No. 29/383,192 filed on Jan. 13, 2011. U.S. Provisional Application . No. 29/383,192 is incorporated by reference herein in its entirety.

FIELD OF THE INVENTION

The invention relates to a stock for a small arms weapon. More particularly, the invention relates to a stock having a compact profile for firing and a sealed, water resistant compartment which may be used to store accessory power supplies, tools or other materials. The invention further relates to a stock for a small arms weapon that has an integrated accessory mounting rail.

BACKGROUND

Small arms may be defined as man-portable individual or crew-served weapon systems used against protected and unprotected personnel and light/unarmored vehicles. These weapon systems may include ballistic and non-ballistic systems and associated munitions, aiming, powering, storage and other ancillary items. Accessories which may be attached to such weapon systems include laser pointers, fire control devices, night vision devices, grenade launchers, optics, thermal weapon sights and other devices. Accordingly, a need exists for a compact, small arms weapon stock that provides secure and water resistant storage for accessory power supplies, tools or other materials, as well as providing a mount for attaching accessories to the stock.

SUMMARY

Hence, the present invention is directed toward a stock of a small arms weapon having an internal compartment and a cover for the compartment which provide a secure and water resistant housing for items stored in the compartment. The present invention also is directed to a stock of a small arms weapon which includes an accessory mounting rail disposed along the underside of the stock.

In one aspect of the present invention, the stock for a small arms weapon may include an upper frame member for receiving a receiver extension. The upper frame member may include a distal end with a receiver extension connection structure, a proximal end, a first longitudinal axis extending between the proximal end and the distal end, and a first cross-sectional profile perpendicular to the first longitudinal axis which defines a maximum outer dimension of the stock. The stock may further include a lower frame member connected to the upper frame member which includes a third end adjacent to the proximal end, a fourth end spaced from the distal end, a second longitudinal axis extending between the third end and the fourth end, the first longitudinal axis and the second longitudinal axis being disposed at an acute angle, a storage chamber inside the lower frame member such that the chamber is configured and dimensioned to house a power supply for a small arms accessory, and a Picatinny rail aligned with the second longitudinal axis.

The stock further may include a third member connecting the first member to the second member. The third member may further include a back plate attachment structure. Additionally, the stock may include a back plate which mates with the back plate attachment stricture. Also, the stock may further include a cover for the chamber such that the cover seals the chamber.

In another aspect of the present invention, the cover may include a recess, a resilient member, and a plug such that the recess mates with the back plate attachment structure, the resilient member interlocks with the attachment structure and the plug fills a portion of the chamber to seal the chamber.

In another aspect of the present invention, the first longitudinal axis and the second longitudinal axis may be disposed at an acute angle, and the acute angle may measure between about 20 degrees and about 30 degrees. In another aspect of the present invention, the acute angle may measure about 30 degrees.

In another aspect of the present invention, the stock may have a maximum width of less than about 2.25 inches. For example, the stock may have a width of between 1.4 inches and 2.0 inches. In yet another aspect of the present invention, the stock may have a maximum width of about 1.9 inches.

In another aspect of the present invention, the chamber may be configured and dimensioned to receive a plurality of batteries in series. For example, the chamber may be configured and dimensioned to receive three CR123 batteries. In another example, the chamber may be configured and dimensioned to receive two AA batteries.

In another aspect of the present invention, the stock for a small arms weapon may include a first member for receiving a receiver extension, and an accessory mounting rail connected to the first member diagonally and which comprises a bottom surface, and plurality of recoil grooves that are spaced along the bottom surface. The accessory mounting rail may further include an interior chamber and an opening to the interior chamber such that the chamber is sized and configured to house a power supply for a small arms accessory. The stock may further include a cover connected to the interior chamber which seals the opening.

The first member further may include a receiver extension attachment site for securing a receiver extension of a small arms weapon. The receiver extension site may secure a receiver extension of a small arms weapon selected from the group consisting of an M4 rifle, M16 rifle, and AR-15 rifle.

In addition, the plurality of recoil groves may be uniformly spaced along the accessory mounting rail. The shape and orientation of the plurality of recoil grooves also may be the same. The plurality of recoil grooves may be parallel grooves, and the accessory mounting rail may be a Picatinny rail. The accessory mounting rail may meet the requirements of MIL STD-1913.

In one embodiment, the stock may have a maximum width of less than about 2.25 inches. In another embodiment, the stock may have a maximum width of between 1.4 inches and 2.0 inches. And. in a preferred embodiment the stock may have a maximum width of about 1.9 inches.

In another aspect of the present invention, the stock may include a first member for receiving a receiver extension. The first member may include a distal end which includes a receiver extension connection structure, a proximal end, and a first longitudinal axis extending between the proximal end and the distal end. The first member also may include a second member connected to the first member. The second member may include a third end adjacent to the proximal end, a fourth end spaced from the distal end, and a second longitudinal axis extending between the third end and the fourth end.

The first longitudinal axis and the second longitudinal axis may be disposed at an acute angle. In one example, the acute angle measures between about 20 degrees and about 30 degrees. In another example, the acute angle measures about 30 degrees.

The second member further may include an accessory mounting rail aligned with the second longitudinal axis. The accessory mounting rail may include a plurality of recoil grooves which are spaced along the second longitudinal axis. The plurality of recoil groves may be uniformly spaced along the accessory mounting rail, the shape and orientation of the plurality of recoil grooves may be the same, and the plurality of recoil grooves may be parallel grooves. The accessory mounting rail may be a Picatinny rail that meets the requirements of MIL-STD-1913.

The accessory mounting rail may further contain an interior chamber such that the chamber is sized and configured to house a power supply for a small arms accessory. For example, the chamber may be configured and dimensioned to receive a plurality of batteries in series. In one embodiment, the chamber is configured and dimensioned to receive three CR123 batteries. In another embodiment, the chamber is configured and dimensioned to receive two AA batteries.

The stock may include a third member connecting the first member to the second member. The third member may include a back plate attachment structure and a back plate which mates with the back plate attachment structure. The stock further may include a cover for the interior chamber such that the cover seals the interior chamber and connects to the back plate attachment structure.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
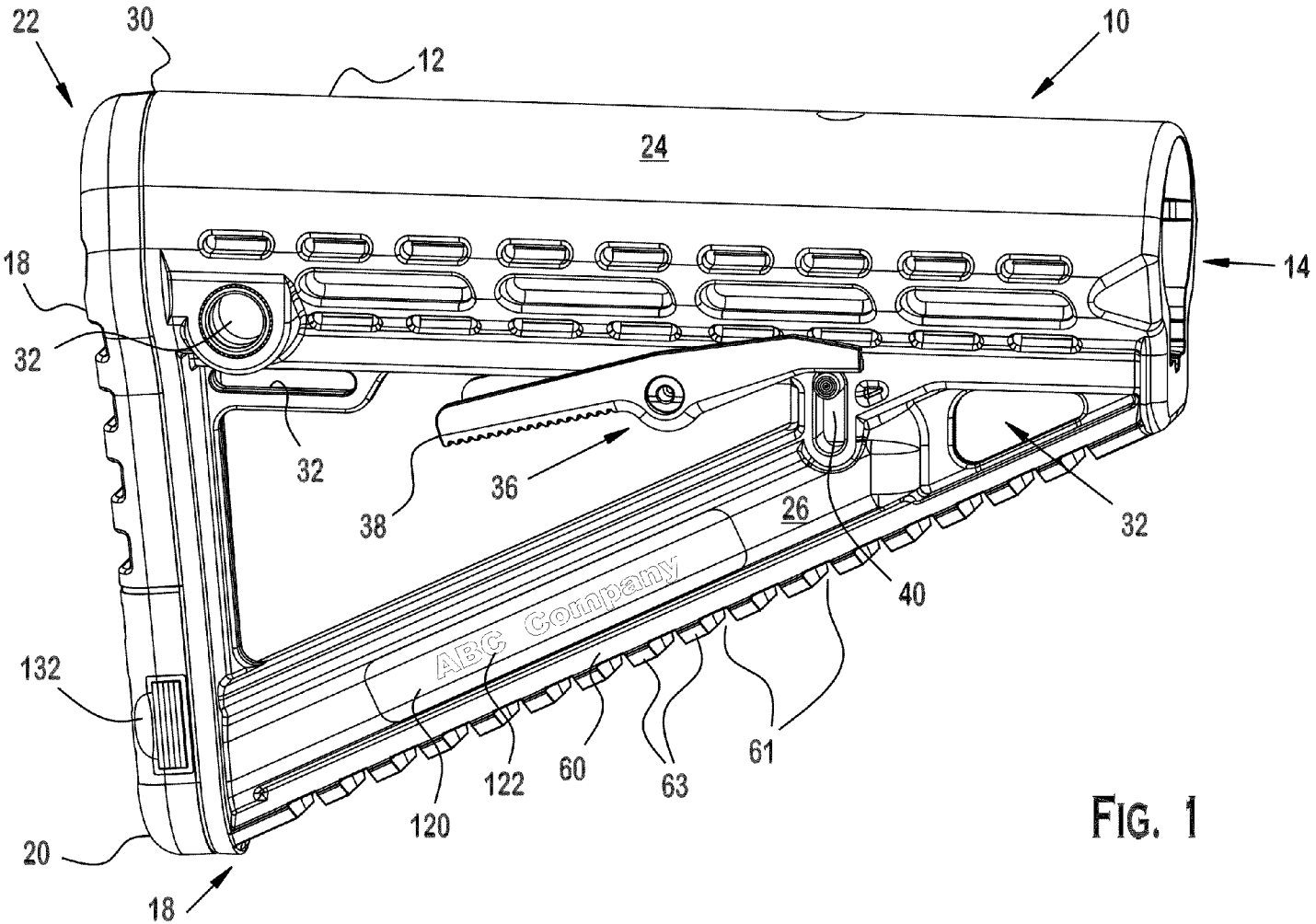
FIG. 1 is a perspective view of an exemplary embodiment of a stock of the present invention.
Figure 2:
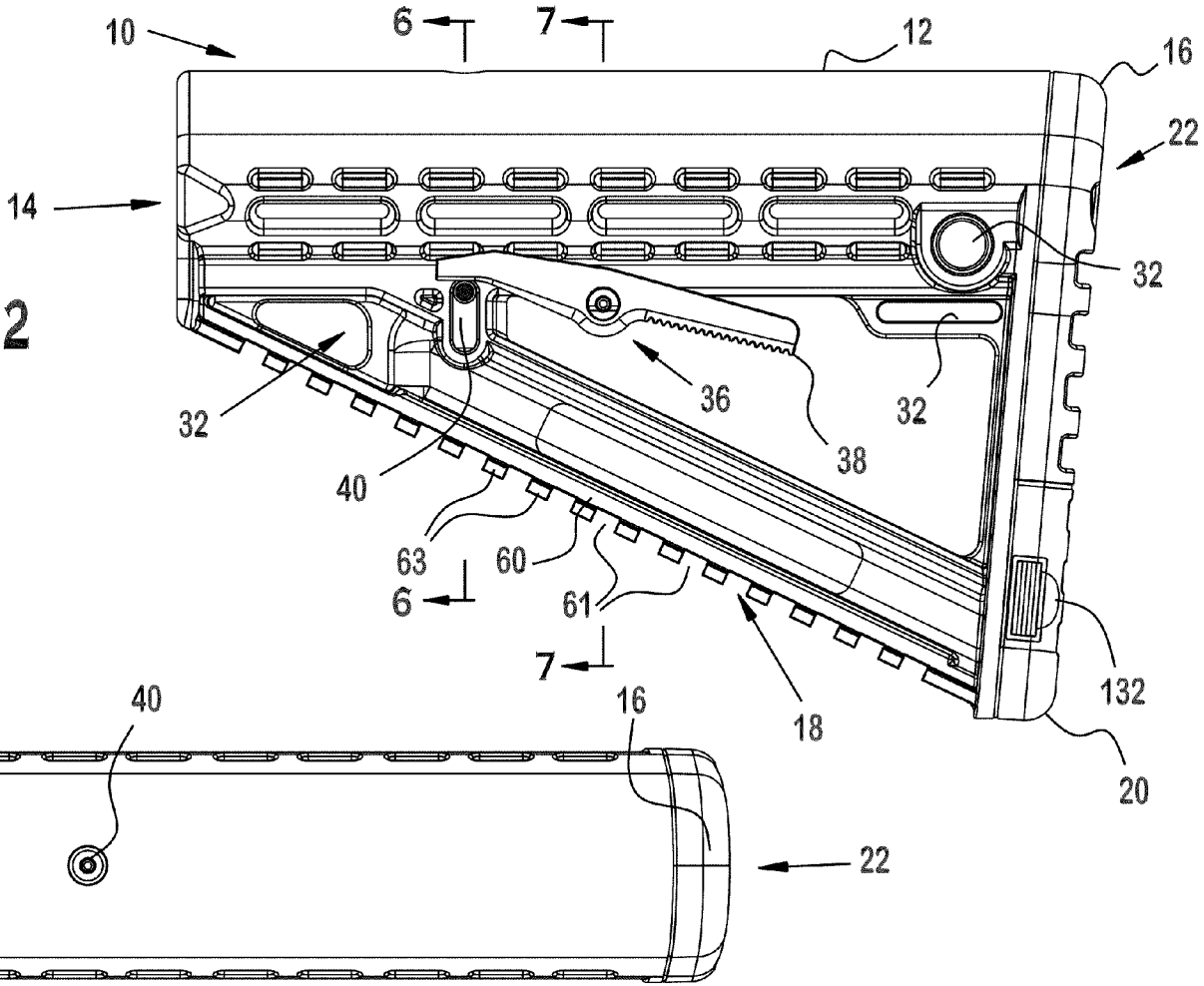
FIG. 2 is a side view of the stock of FIG. 1.
Figure 5:
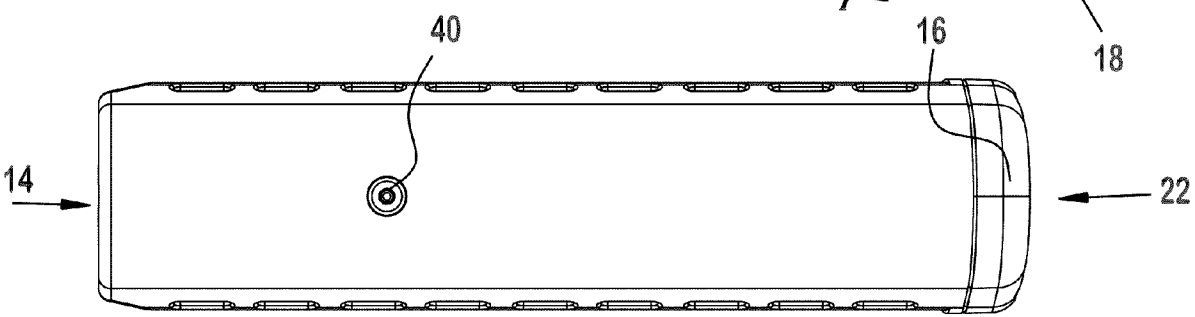
FIG. 5 is a top view of the stock of FIG. 1.
Figure 3:
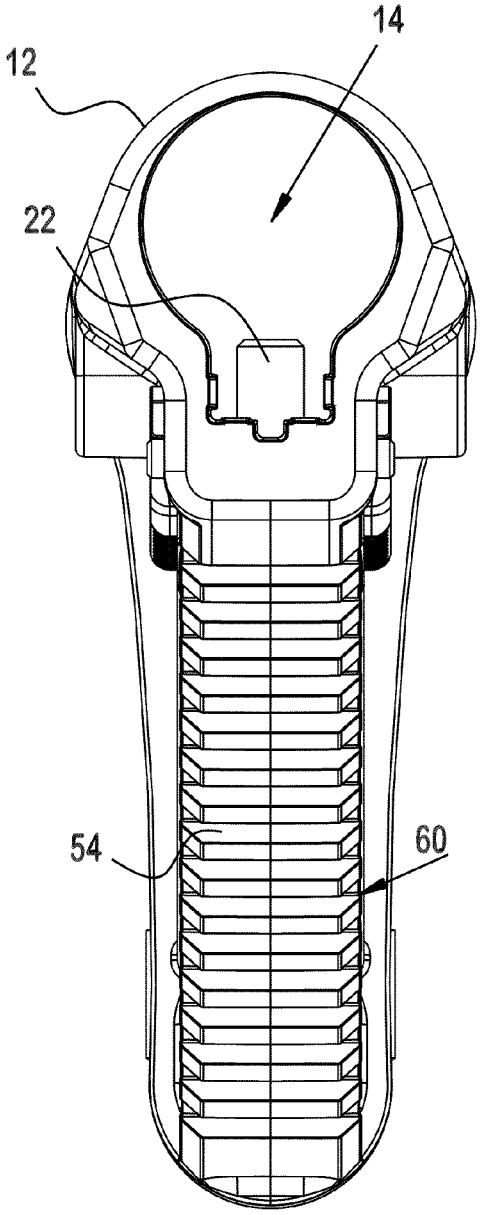
FIG. 3 is a front view of the stock of FIG. 1.
Figure 4:
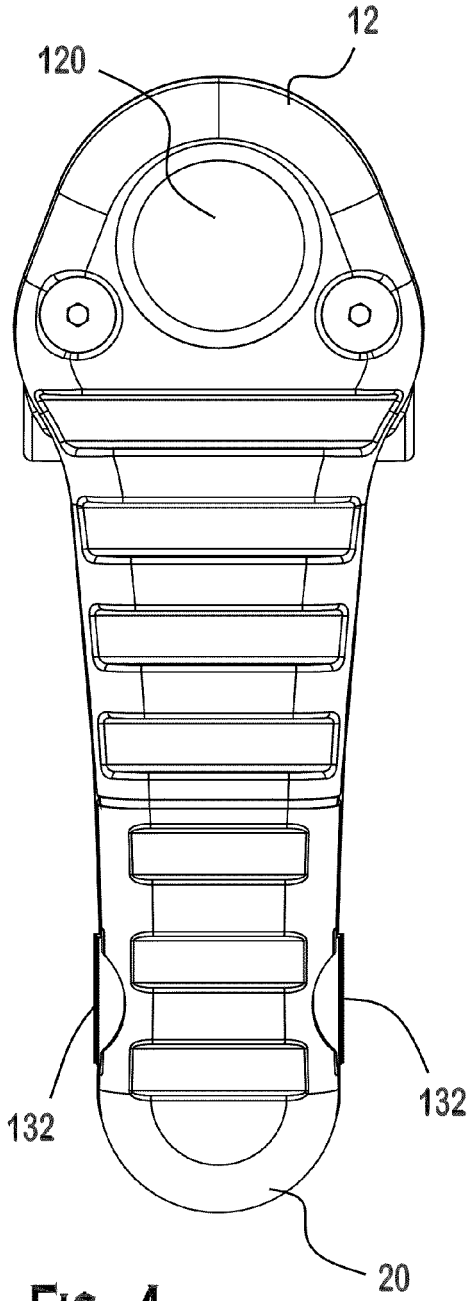
FIG. 4 is a rear view of the stock of FIG. 1.

FIG. 1 illustrates an exemplary embodiment of a stock 10 having a frame 12, a receiver extension (or buffer tube) attachment site 14. a replaceable rubber back plate 16, an internal storage compartment 18 and a cover 20 on the rear end 22 of the stock.

As shown in FIGS. 1, 2, 8-9 and 12, the frame 12 may be formed from three primary structural members. including: a first elongated member 24 that receives a receiver extension at the distal end of the first member, a second elongated member 26 that houses the storage compartment 18, and a third elongated member 28 which connects the proximal ends of the first and second members and forms a back plate area 30. The first member may define a first longitudinal axis. The second member may define a second longitudinal axis, and the first longitudinal axis and the second longitudinal axis may be disposed at an acute angle. For example, the acute angle may measure between about 20 degrees and about 30 degrees. In another example, the acute angle may measure about 30 degrees.

Preferably, the stock 10 may have a maximum width of less than about 2.25 inches. More preferably, the stock may have a maximum width of between 1.4 inches and 2.0 inches. And, in a most preferred embodiment the stock may have a maximum width of about 1.9 inches.

In a preferred embodiment, the frame may be a fiber-reinforced polymer, such as nylon 6/6 with 30% glass, carbon or aramid fiber threads, but any strong and durable material may be used. For example, the frame may be manufactured from aircraft quality aluminum. Although lightweight materials may be preferred for many applications, heavier materials, such as titanium, steel or other alloys also may be used to fabricate the frame.

Referring to FIGS. 1, 2, 8 and 12, the frame 12 further may include one or more ring structures 32 for securing a tactical sling.

Figure 29:
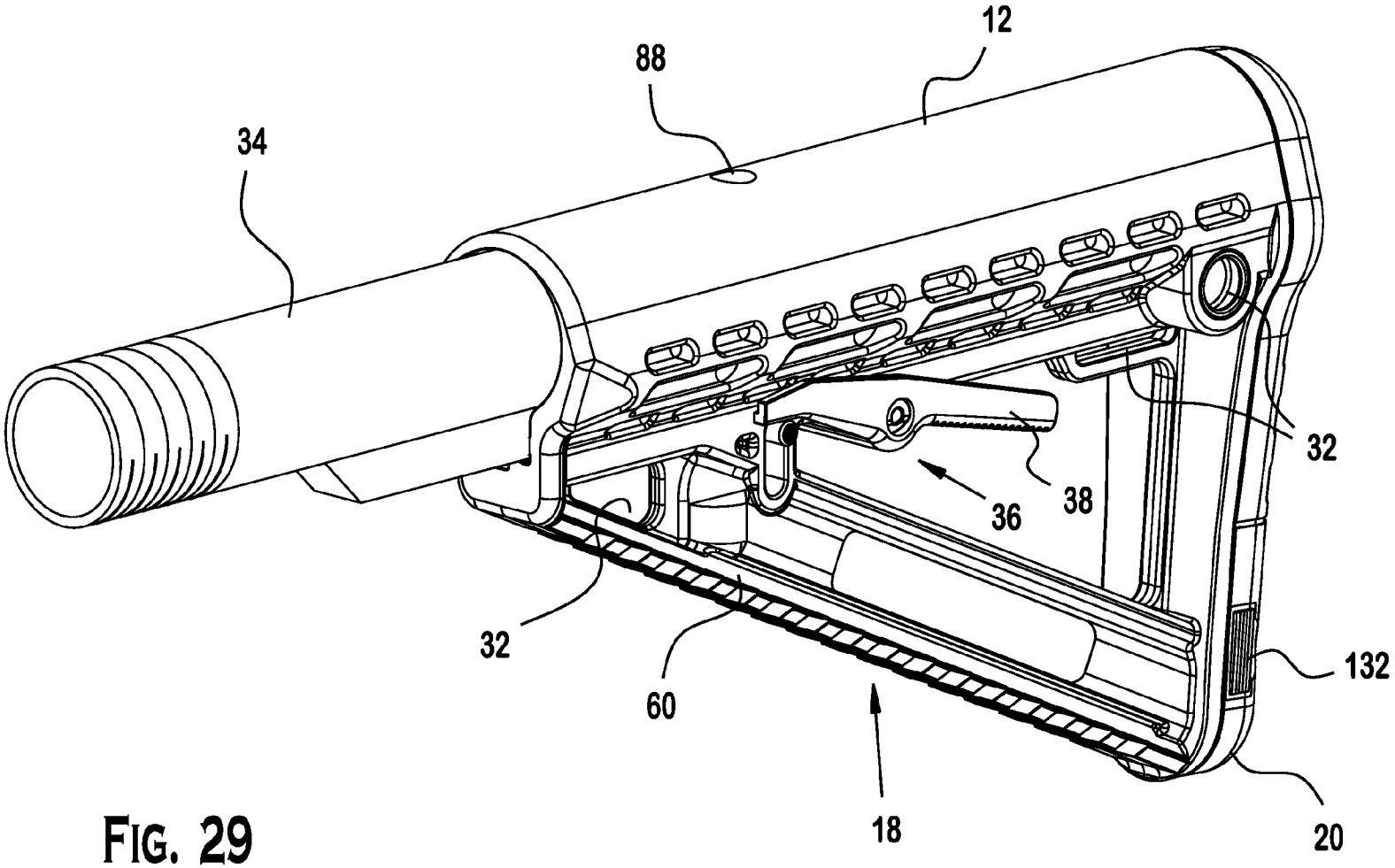
FIG. 29 is a perspective view of the stock of FIG. 1, secured to a receiver extension.
Figure 30:
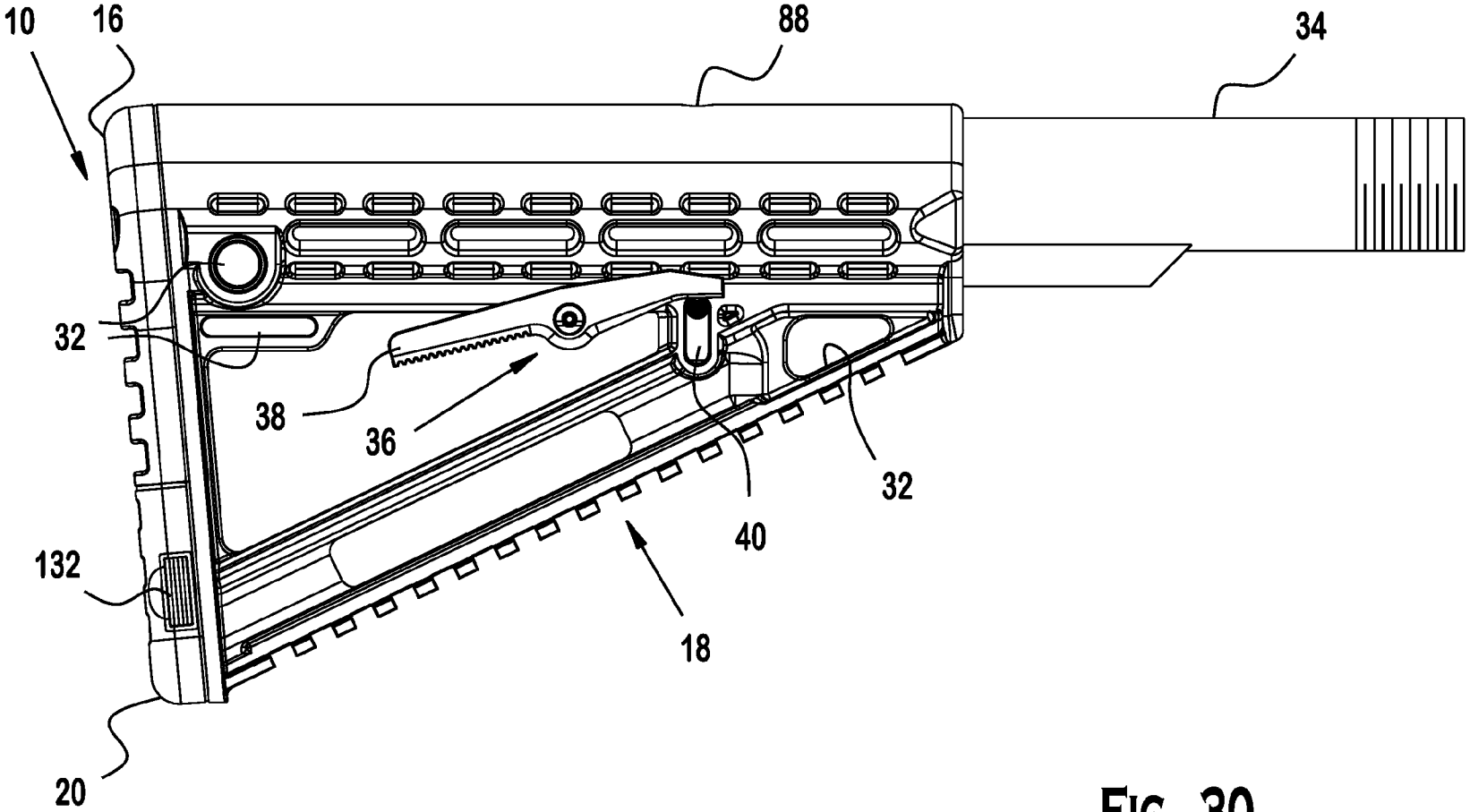
FIG. 30 is a front view of the stock and receiver extension of FIG. 29.

Referring to FIGS. 29 and 30, the frame 12 further may include a receiver extension (or buffer tube) 34 secured to the frame at the receiver extension attachment site 14. The receiver extension 34 may be threaded or otherwise configured and dimensioned to mate with or connect to a portion of a rifle, for example, a receiver for an AR-15 rifle or M4 modular weapon.

The frame 12 further may include a mechanism 36 for selectively allowing or locking relative movement of the frame with respect to the buffer tube 34. For example, the mechanism 36 may include lever 38 and a spring loaded sliding member (or locking pin) 40. The mechanism 36 is operable between first and second states, such that in the first state the sliding member 40 locks the frame 12 with respect to the receiver extension 14 and in the second state allows the frame 12 to translate with respect to the receiver extension 34.

Figure 14:
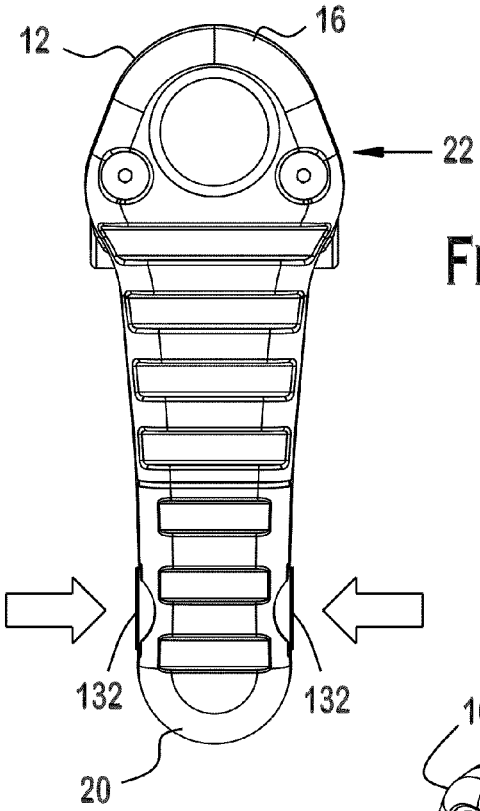
FIG. 14 is a right side view of the rifle of FIG. 1, illustrating the cover and release mechanism for the sealed battery compartment in the closed configuration.
Figure 15:
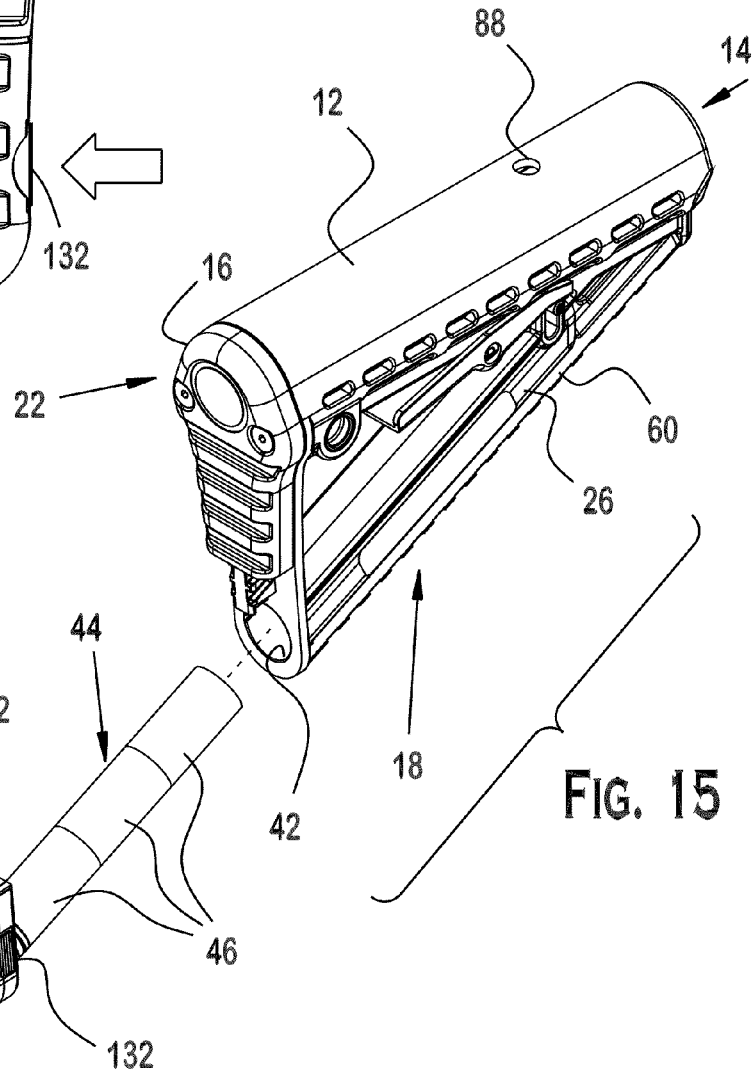
FIG. 15 is a perspective view of the stock of FIG. 1 from the right rear, illustrating the cover and contents of the sealed battery compartment in the open configuration.

Referring to FIGS. 1, 14 and 15, the frame 12 further may include a sealed battery compartment 18 disposed at the lowest portion of the stock 10. In this embodiment, the sealed battery compartment 18 includes a cover 20 at the base of the rear end of the stock 22. In a preferred embodiment, the compartment 18 is defined by a cylindrical chamber 42 disposed within the lower of three members 26 that form the structural frame of the stock. In this embodiment, the diameter of the cylindrical chamber (or storage compartment) 42 is approximately 17 mm and the length is approximately 100 mm.

Figure 16:
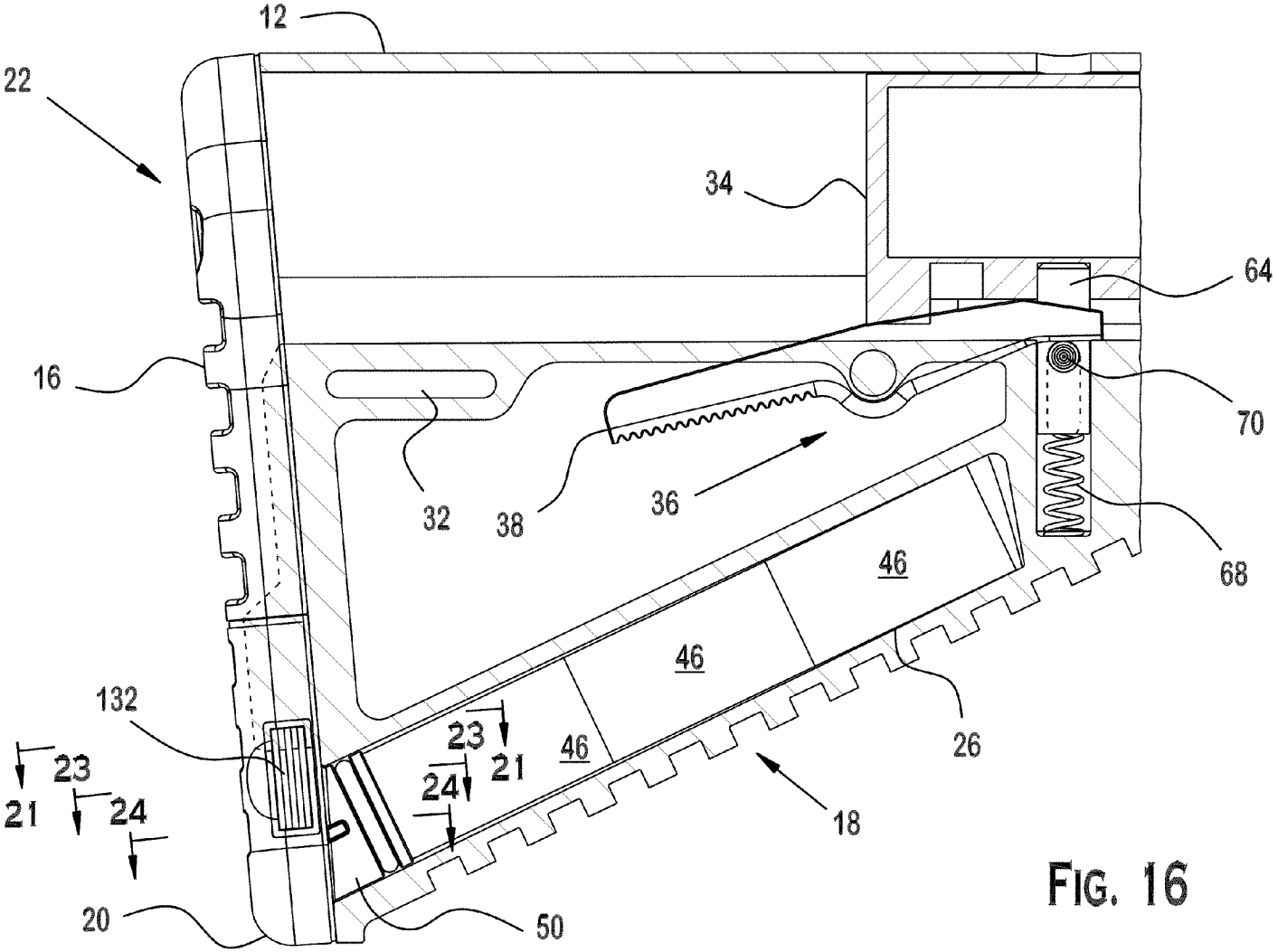
FIG. 16 is a partial section view of the stock of FIG. 1, illustrating three CR123 batteries, disposed within the sealed battery compartment.
Figure 17:
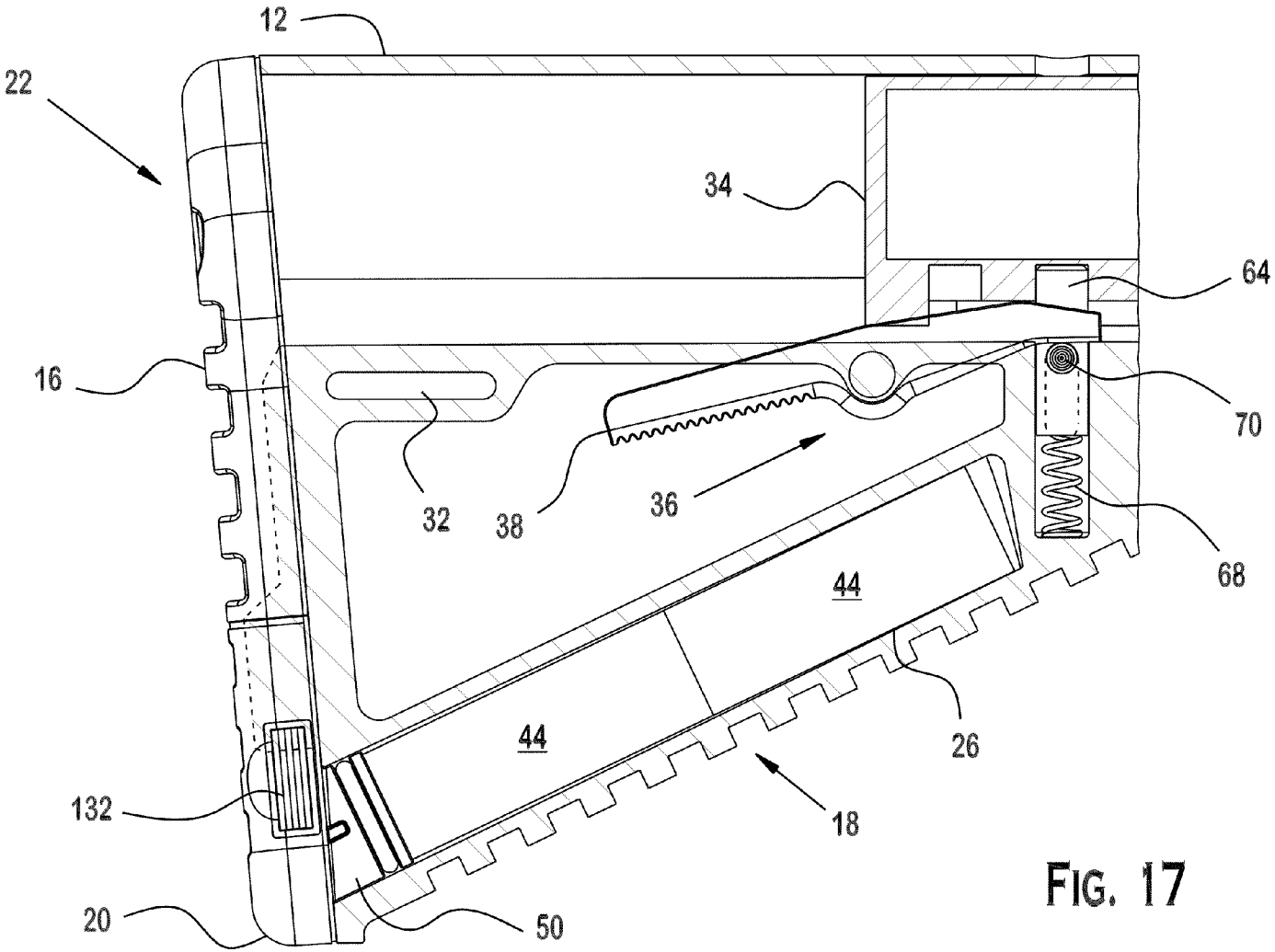
FIG. 17 is a partial sectional view of the stock of FIG. 1, illustrating two AA batteries disposed within the sealed battery compartment.

As shown in FIGS. 15-17, the storage compartment 42 may be configured and dimensioned to receive batteries 44. For example, three CR123 batteries 46 may be held in series within the sealed compartment 42 when the cover 20, cover attachment mechanism 132, and frame 16 are in the first configuration. In another example, two AA batteries 44 may be held in the sealed compartment 18 when the cover 20, cover attachment mechanism 48 and frame 12 are in the first configuration.

In yet another example, the storage compartment 42 further may include electrical components. such as wire or resilient contacts for electrically connecting the stored batteries to a rifle mounted tactical accessory. For instance, the sealed compartment 42 may contain a pair of resilient contacts connected to an electrical circuit for powering an adjacent accessory. In an illustrative embodiment, the storage compartment may contain two AA batteries in series, and the resilient contacts may be electrically connected to a jack disposed on the rear cover. A power cord further may be inserted into the jack to deliver electricity to the accessory, such as a rifle tactical light, scope, laser or communication system.

Figure 8:
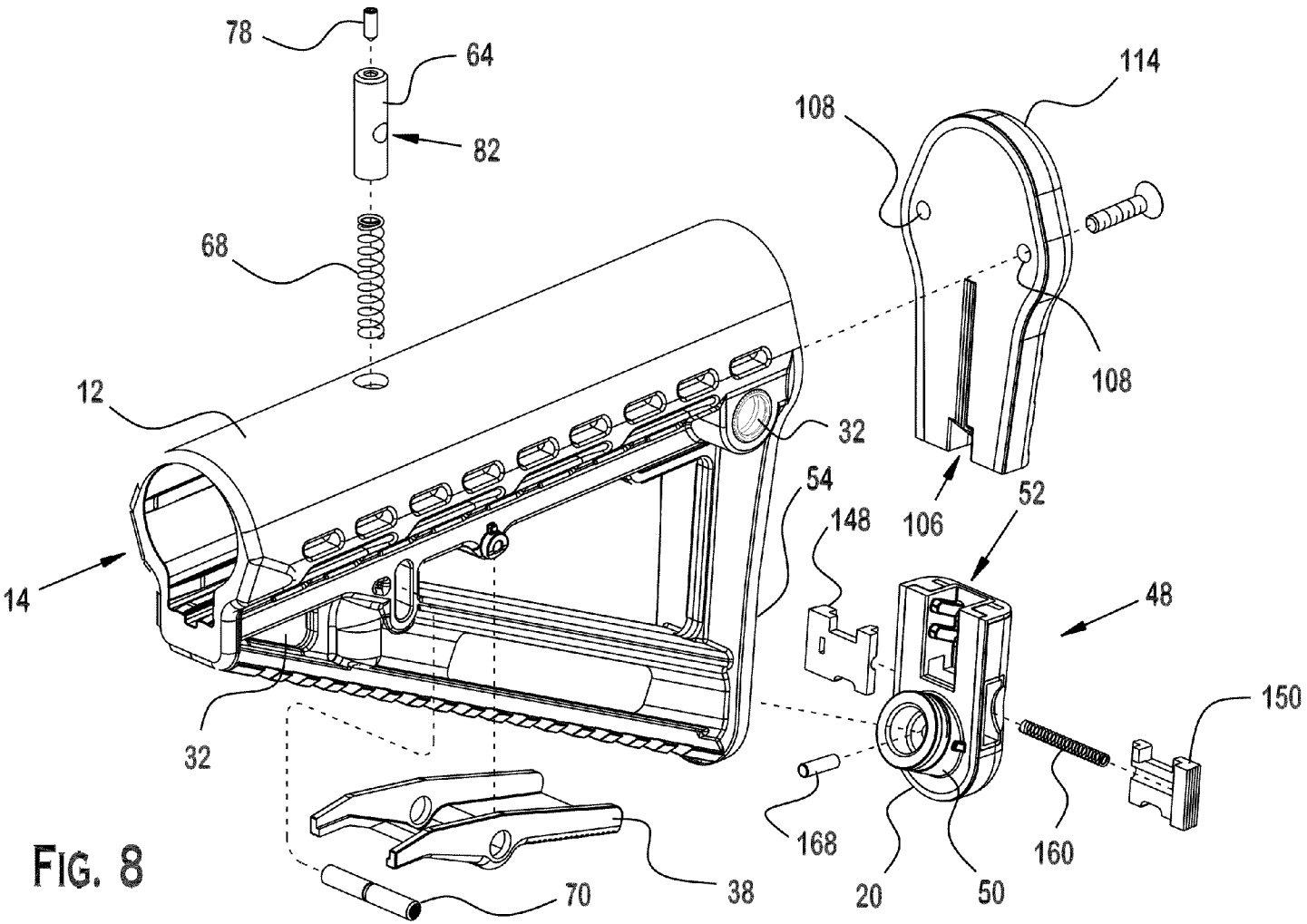
FIG. 8 is an exploded view of the stock of FIG. 1.

Referring to FIG. 8, the cover 20 may be secured to the frame 12 by an attachment mechanism 48. For example, in a first configuration, the cover 20 and cover attachment mechanism 48 may mate with the frame 12 to secure and seal the storage compartment 42. In a second configuration, the cover 20 and attachment mechanism 48 may separate from the frame 12 to provide access to the storage compartment 42.

Referring to FIGS. 8 and 15-17, the cover 20, may include a plug 50, a recess 52 and a latch 132 which mate with the frame 12. For example, the plug 50 may be configured and dimensioned to form a snug fit with the cylindrical chamber 42, the recess 52 may be configured and dimensioned to mate with the projection (or catch) 54, and the latch 132 may operate to selectively interlock with a portion of the catch, for example T-shaped structure 124. Thus, the attachment mechanism 48 may include the plug 50, recess 52, and latch 132, which cooperate with the frame to secure the cover to the frame, as well as seal the storage compartment 42. In one configuration, the attachment mechanism 48 may lock the cover 20 to the projection 54 and in a second configuration may allow the cover 20 to be separated from the projection 54.

Figure 19:
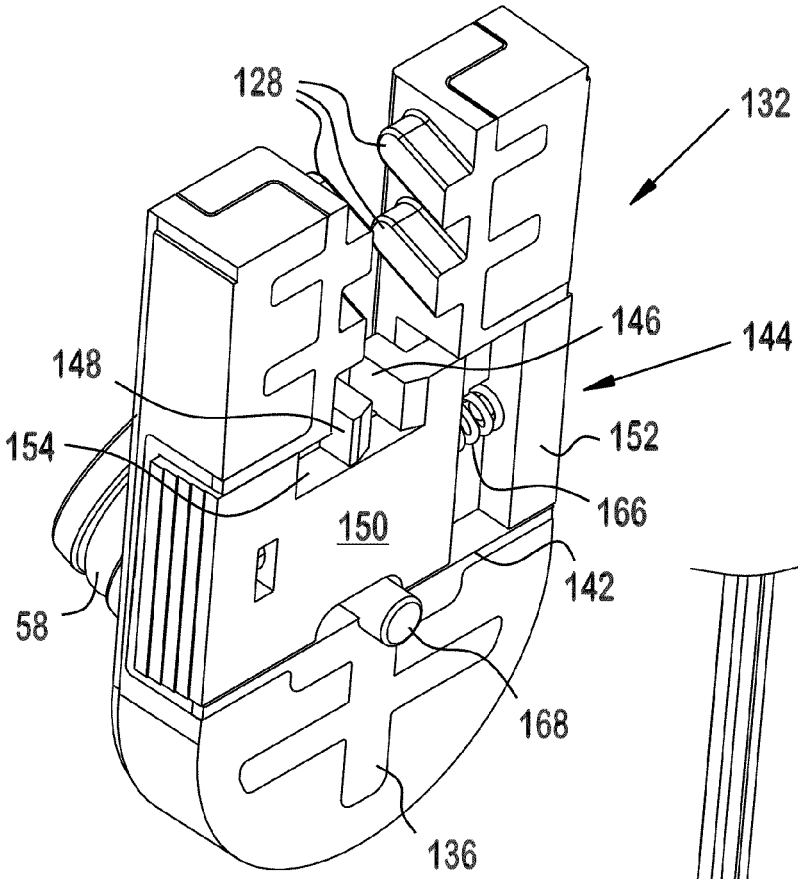
FIG. 19 is a perspective of the plug with cover broken away.

Referring to FIGS. 8 and 19, the cover 20 further may include a recess (or seat) 56 for receiving an O-ring 58, which creates a seal for the compartment. The sealed plug 50 and secure cover 20 prevent moisture and water from entering the storage compartment.

Referring to FIGS. 1, 2, 25-26 and 30, the frame 12 may include an accessory mounting rail 60, such as a Picatinny rail. The Picatinny rail 60 may be integrated into the frame 12 such that the sealed battery storage compartment 18 is disposed on (or within) the accessory mounting rail 60. Referring to FIGS. 2, 3, 7 and 27-28, the accessory mounting rail 60 may be a grooved 61 dovetail feature 63 that provides a mounting platform to mount items for small arms weapons, such as laser pointers, fire control devices, night vision devices, optics, thermal weapon sights, and other accessories for man-portable individual and crew-served weapon systems.

Referring back to FIG. 6, the receiver extension locking mechanism 36 includes a vertical locking pin 64. a slot 66 for receiving the vertical locking pin 64, a spring 68 disposed in the slot 66, a lever 70 disposed horizontally in the locking pin 64. The locking pin 64 has an upper end 72 which engages the receiver extension (buffer tube) 34 and a lower end 74 which is set within the slot 66. The upper end 72 of the locking pin 64 includes a threaded bore 76 and a set screw 78 disposed within the threaded bore 76. The lower end 74 of the locking pin includes a recess 80 for receiving a portion of the spring 68. The locking pin 64 further includes a horizontal through hole 82 that is disposed between the threaded bore 76 and recess 80. The lever 70 may be an elongated member with a circumferential groove 84 disposed in the middle of the elongated member. The lever 70 may be secured to the through hole 82 by the set screw 78, as the set screw may be advanced within the threaded bore 76 until the lower end of the set screw 78 is interposed within the circumferential groove 84. The set screw 78 may be advanced against the lever 70 further to compress the lever against the side wall of the horizontal through hole 82, and further secure the fixed connection between the lever 70 and the locking pin 64.

The receiver extension locking mechanism 62 further includes the receiver extension release lever 38. The receiver extension release lever 38 may have two lever arms 86. The lever arms 86 are disposed on the upper surface of the lever 70. The upper end of the locking pin 72 may be withdrawn from the receiver extension (buffer tube) 34 by pressing the working end of the release lever 38 toward the buffer tube. This rotates the release lever 38 about a pivot and moves the receiver extension release lever arms 86 away from the buffer tube 34. As the extension release lever arms 86 move away from the buffer tube, the lever arms 86 press against the lever 70 and vertical locking pin 40, moving the locking pin 40 lower into the slot 66. In this manner, the vertical locking pin may move down the slot until the tipper end portion 72 of the locking tube disengages from the buffer tube 34, allowing relative movement between the stock and the buffer tube.

Figure 6:
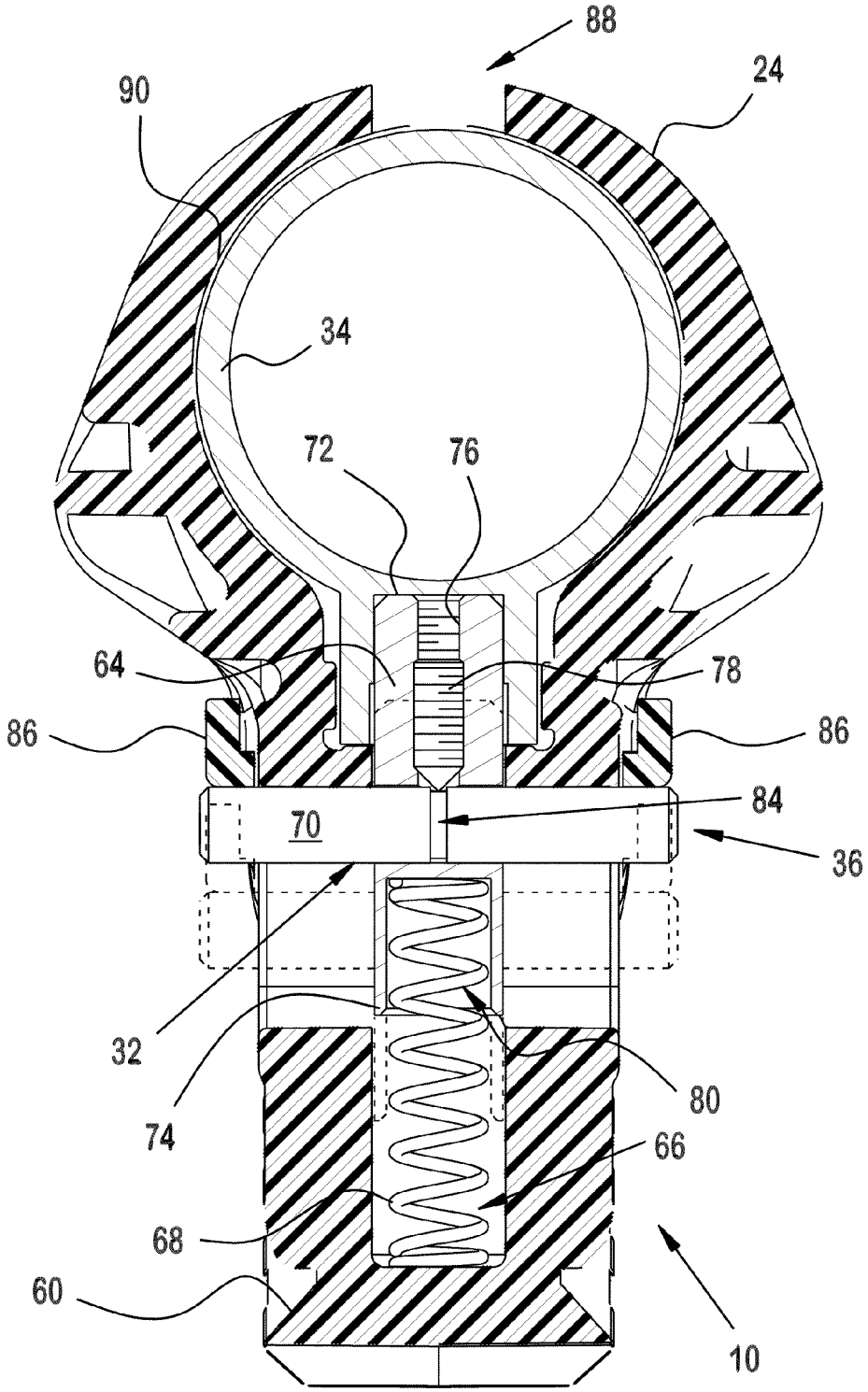
FIG. 6 is a cross section through the spring latch pin and lever of FIG. 2.

Also visible in FIG. 6 is an opening 88 in the top of the frame 12 for inserting the spring 68 and vertical locking pin 82 into the slot 66.

Still referring to FIG. 6, the buffer tube 34 is disposed within the receiver extension attachment site 14. In this embodiment, the receiver extension attachment site 14 includes a tubular cavity within the upper member 24 of the frame. The tubular cavity has a circular upper portion 90 and a generally square base portion 92. The tubular cavity is configured and dimensioned to telescopically receive a receive extension (or buffer tube) 34 of a small arms weapon. In the exemplary embodiment shown in FIG. 6. the tubular cavity is configured and dimensioned to receive a receiver extension of an M-16 rifle. The locking pin 64 is engaged with the lower portion of the receiver extension (buffer tube) 14 to block translational movement between the receiver extension (buffer tube) 34 and the stock 10. The spring 68 biases the vertical locking pin into engagement with the receiver extension 35. To prevent buckling of the spring, a small projection may be placed at the base of the slot to guide and support the spring coil during spring compression as it is compressed.

Figure 7:
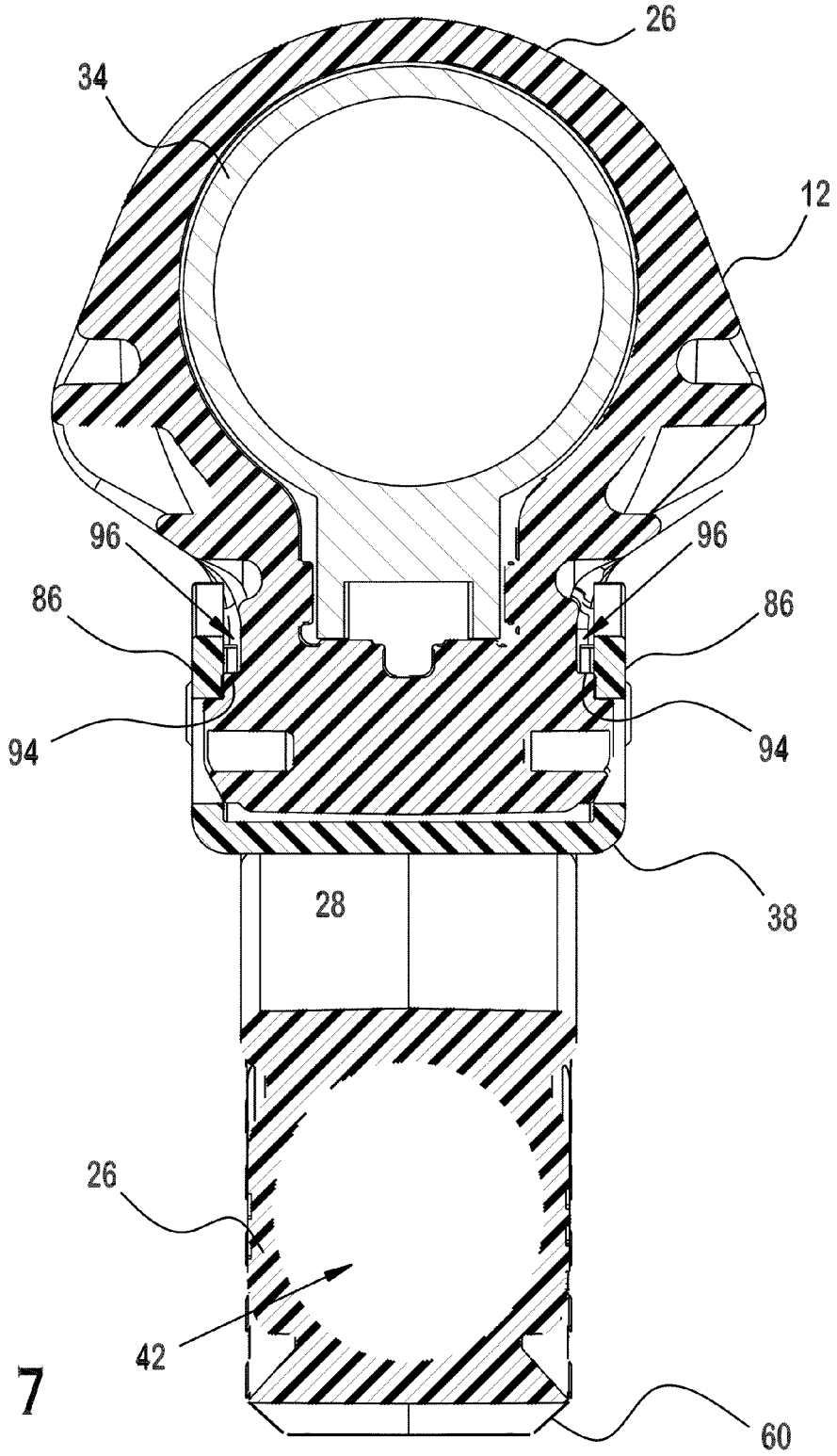
FIG. 7 is a cross section through the lever pivot of FIG. 2.

Referring to FIG. 7, the receiver extension release lever 38 may be connected to the frame 12 by a pair of protrusions (or projections) 94 which mate with a pair of receptacles 96 on the frame.

Figure 18:
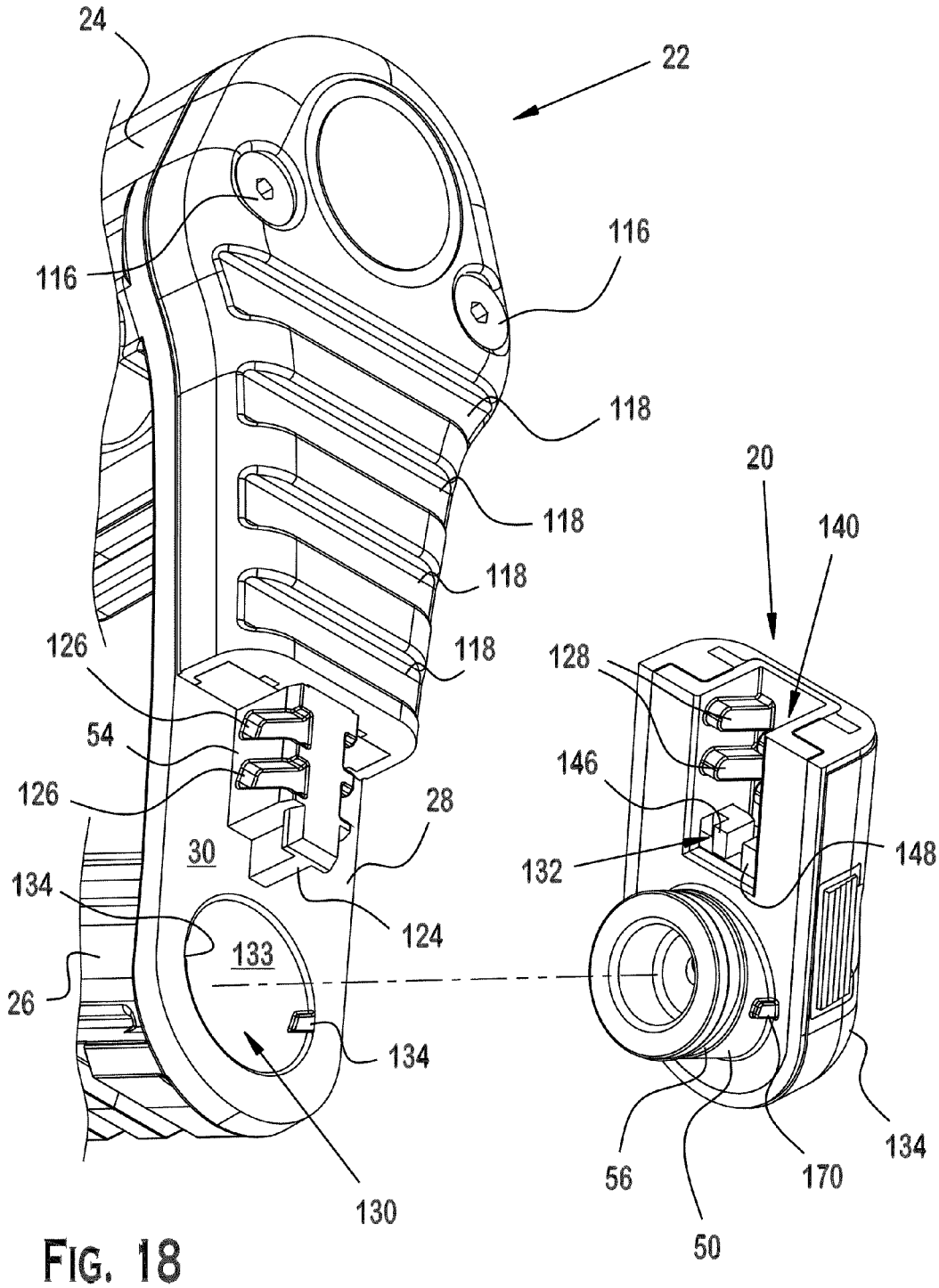
FIG. 18 is an exploded perspective showing the plug and back of stock.

Referring to FIG. 18. the rear end of the stock 22 may include a third member 28 which connects the upper elongated member 24 to the lower elongated member 26 to form the frame 12.

Referring to FIG. 8, the rubber back plate 16 may include a slot 106 and two through holes 108. The slot 106 and through holes 108 may be used to secure the rubber back plate 16 to the frame 12. For example, the through holes 108 may be sized to receive threaded inserts that utilize self-clinching, broaching, flaring, surface mount, or weld technology to provide strong, reusable, and permanent threads for mating with a fastener. For instance, the threaded insert may be a PEM™ tapered through threaded and heat staked insert manufactured by Penn Engineering of Danboro, Pa. More particularly. the inserts may be PEM™ part number IUTB-.164-32 and the fasteners may be #8 screws. The screws may be made from aluminum, carbon steel, stainless steel or other suitable material.

The threaded insert may be installed by pressing the insert into the mounting hole with ultrasonic insertion equipment while simultaneously applying a high frequency vibration. Frictional heat caused by the vibration melts the plastic surrounding the insert allowing easy insertion. When the vibration ceases, the plastic solidifies, locking the threaded insert permanently in place. Alternatively, the threaded insert may be installed by pressing the insert into the mounting hole with a thermal press to melt the plastic surrounding the threaded insert.

Alternatively, the threaded inserts may be installed during the molding process. More specifically, the threaded inserts may be located in the mold cavity by core pins. When the mold opens, the core pins are withdrawn leaving the threaded inserts permanently encapsulated in the plastic section with only the threads exposed. Also, the threaded inserts may be installed by simply pressing the threaded inserts into premolded or drilled holes. Installation is accomplished using any standard press at any time during the production process.

Figure 9:
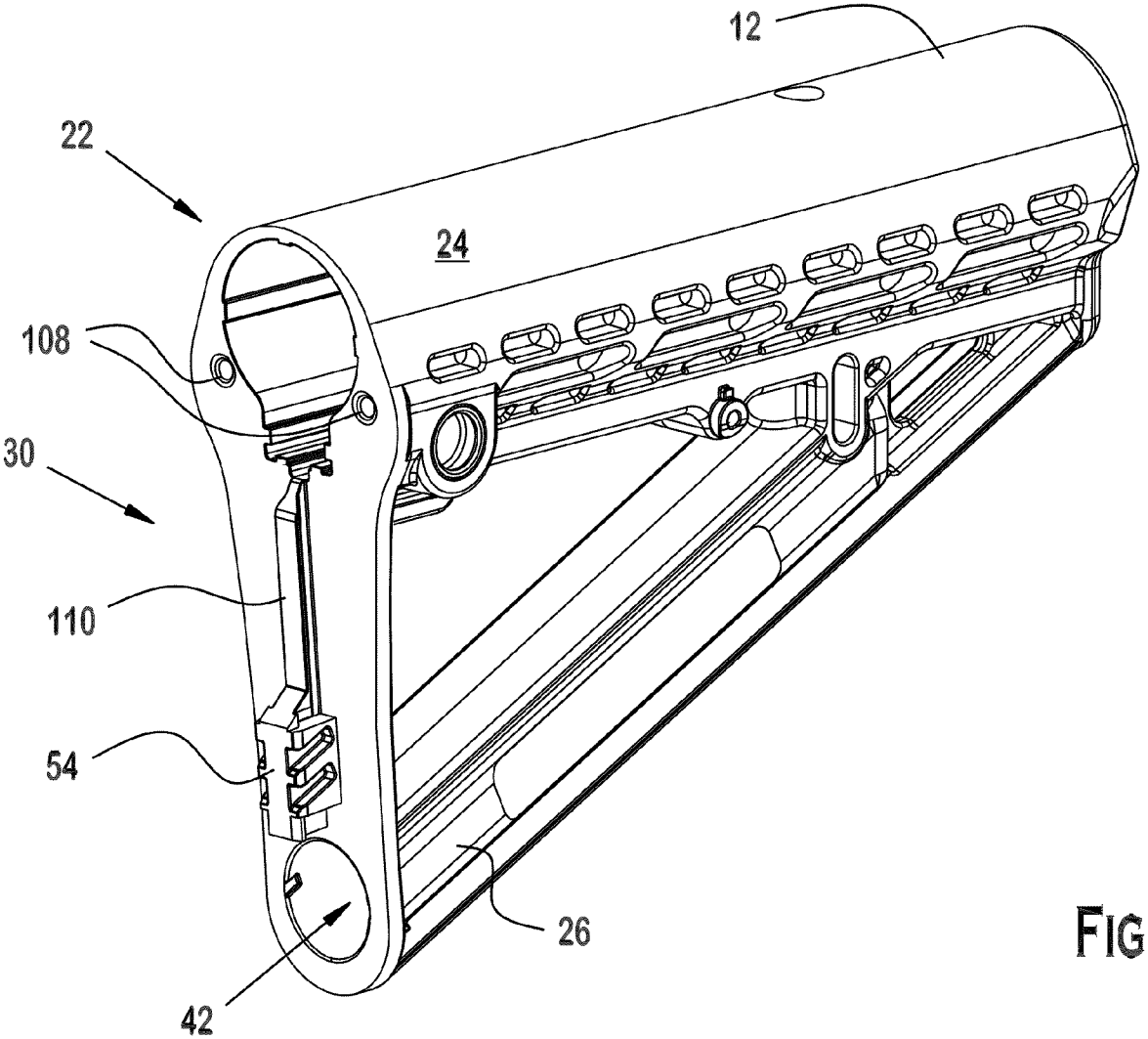
FIG. 9 is a perspective view of the stock frame of FIG. 1 from the right rear.

Referring to FIG. 9, the frame 12 may include a projection (or rail) 110 that is configured and dimensioned to slidably receive the rubber back plate 16. Moreover, the projection 110 may include a block portion (or catch) 54 that is adapted to mate with the cover 20, and thus the projection 110 also may form part of the cover attachment mechanism 48.

Figure 10:
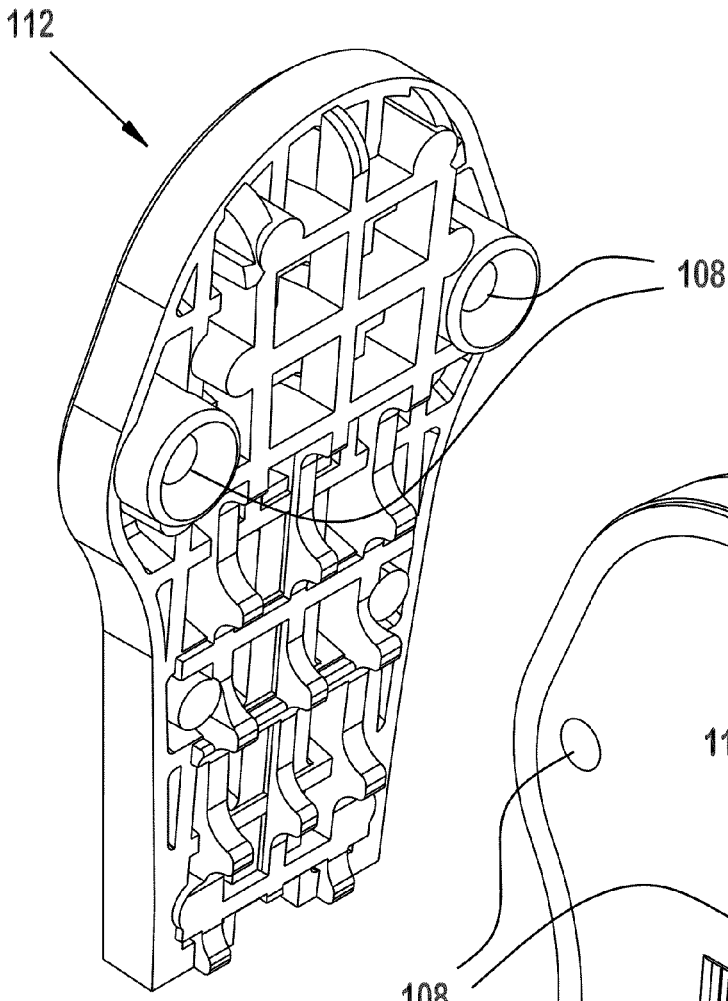
FIG. 10 is a perspective view of one embodiment of the back plate chassis.
Figure 11:
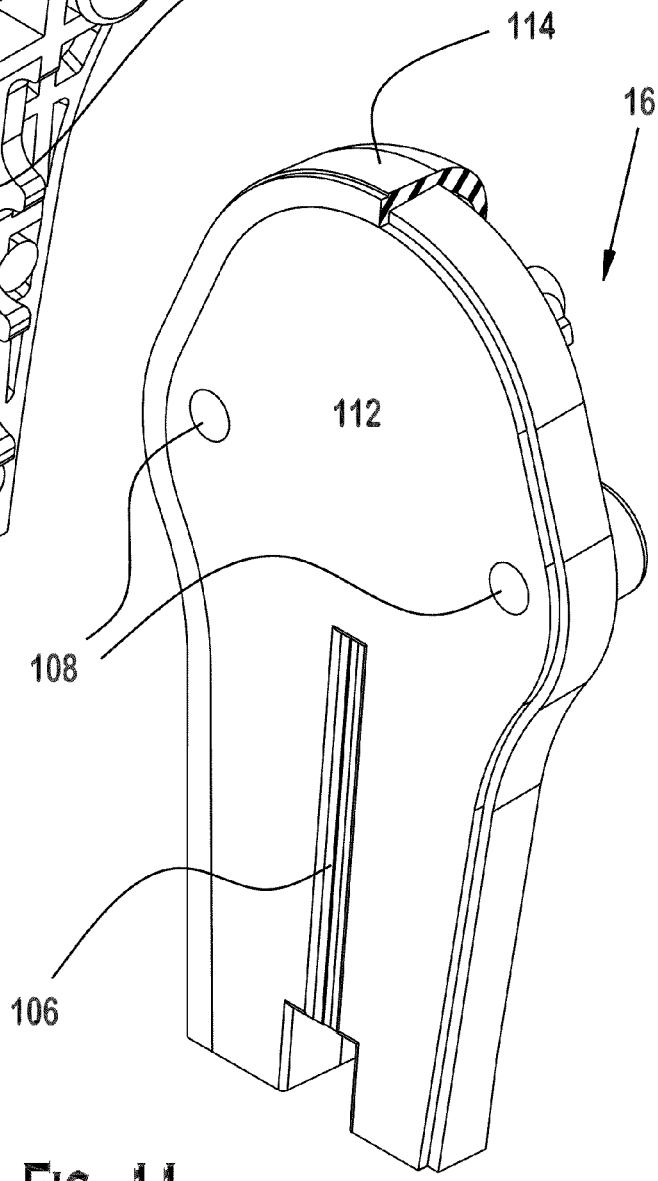
FIG. 11 is perspective view of one embodiment of the back plate chassis and over molded rubber.
Figure 13:
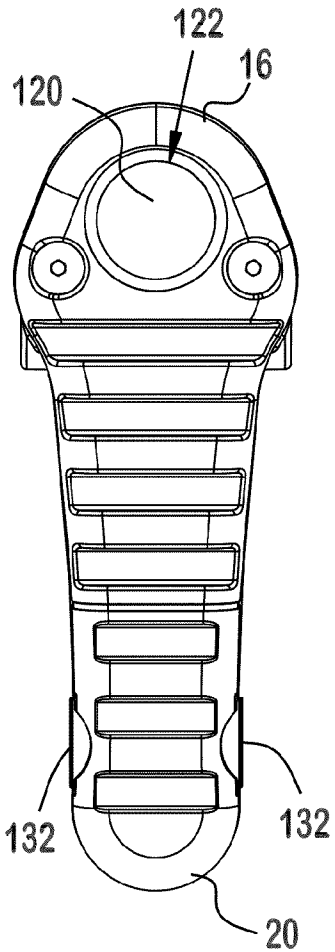
FIG. 13 is a rear side view of the rifle of FIG. 12.
Figure 12:
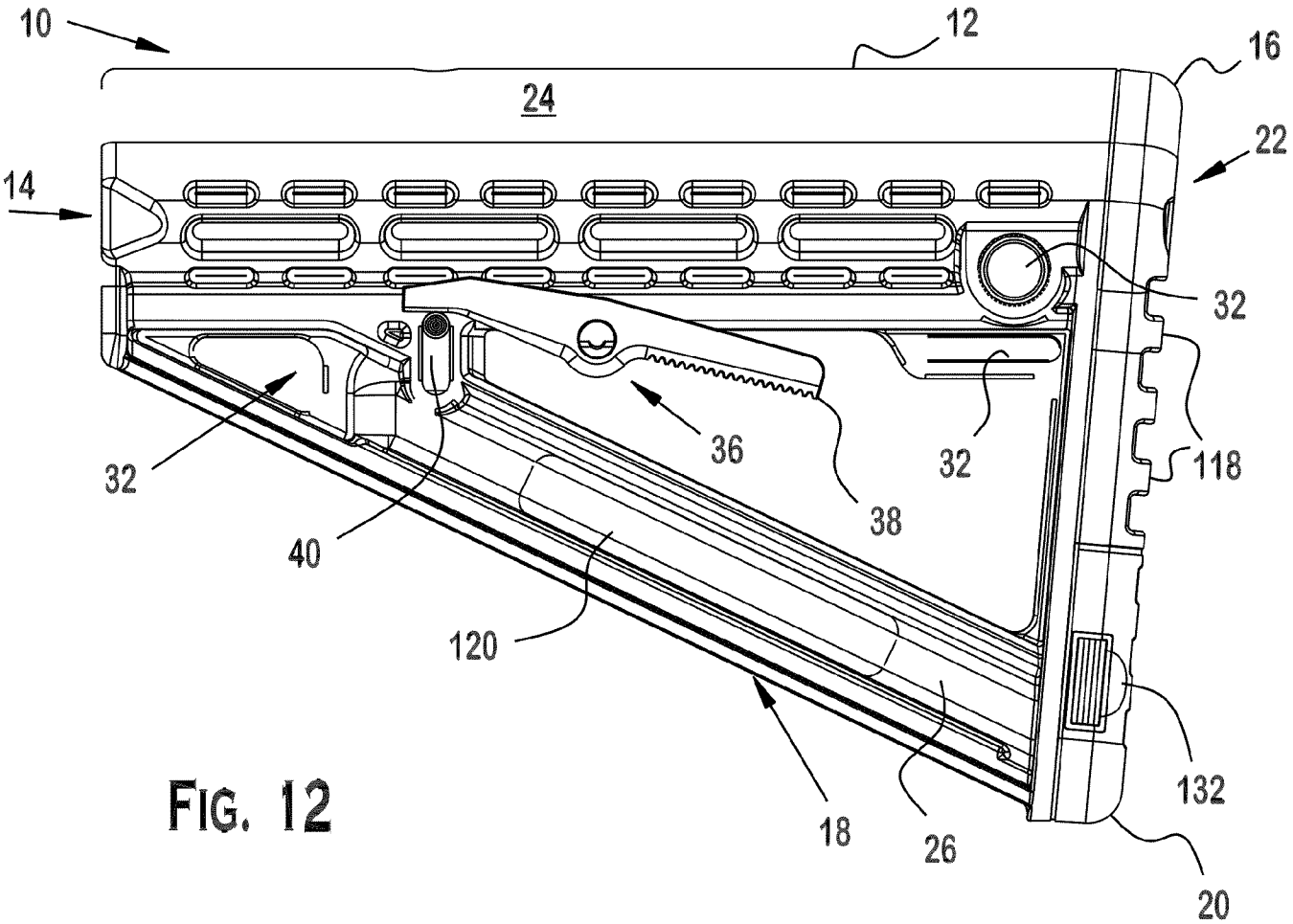
FIG. 12 is a side view of another embodiment of the rifle stock of the present invention.

Referring to FIGS. 10 and 11, the rubber back plate 16 may be formed from a chassis 112 and a rubber covering 114. The rubber covering 114 may be over molded onto the chassis 112. Additionally, the rubber covering and the chassis may be secured to the back plate area 30 by a fastener 116. For example, the rubber covering and the back plate may be secured to the back plate by two screws. The two screws may be inserted into through holes 108 on the rubber covering and back plate insert assembly and advanced into threaded inserts that arc within the upper elongated member 24. Referring to FIGS. 12 and 13, the rubber covering may include raised sections 118 to enhance the cushioning effect of the resilient material. The rubber covering 114 may also include an indicia placement area 120. For example, a company logo or trademark may be placed in the indicia placement area.

Referring to FIG. 9, designated areas of the stock 10 and rubber back plate 16 may be configured and dimensioned to bear indicia 122 such as a logo or company name. These indicia 122 may be formed integrally with the frame 12 or rubber back plate 16 by an insert placed within the respective mold. Alternatively, the indicia may be formed on a separate work piece and then secured to the frame or back plate by any suitable means, such as by a fastener, press-fit connection, ultrasonic welding and/or solvent cement welding.

Figure 20:
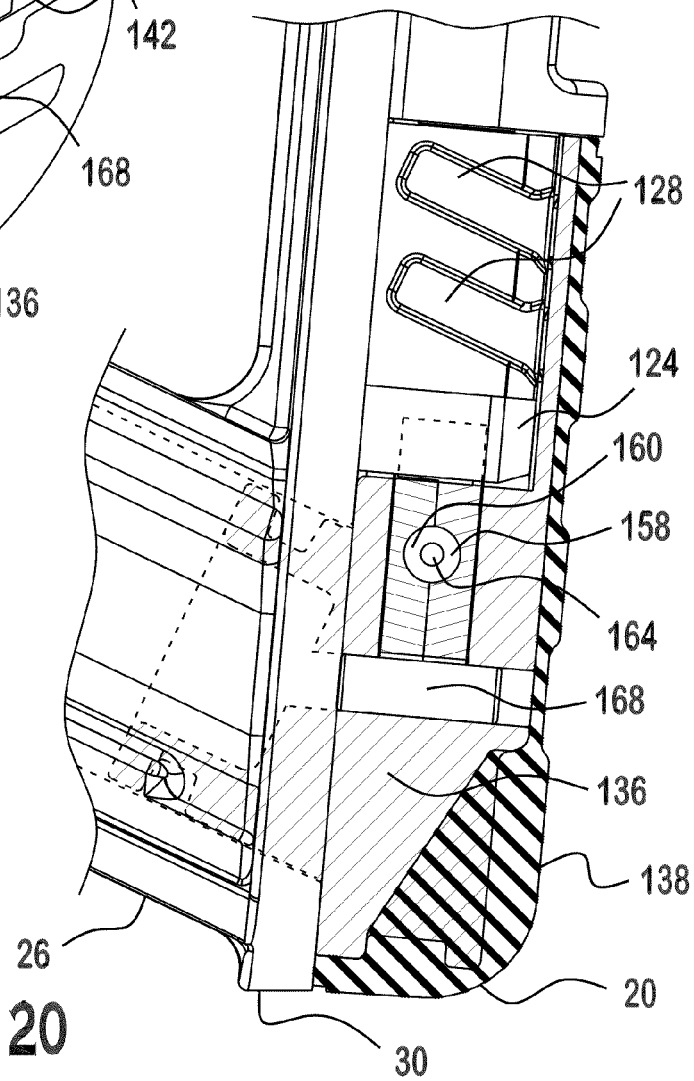
FIG. 20 is a vertical cross section through the plug as it is assembled on the stock.

Referring to FIGS. 18 and 20, the lower portion of the back plate area 30 may include a catch 54 for securing the rear cover 20 to the stock. The catch 54 may include a T-shaped structure 124 for preventing rearward movement of a mating latch. The catch 54 may further include one or more grooves 126. For example, four grooves may be above the T-shaped catch. The grooves may be configured and dimensioned to mate with ribs 128 on the mating latch. The grooves 126 may be disposed at an angle. The mating latch may be formed within the rear cover 20.

As shown in FIG. 18, the back plate area includes an opening to a bore within the lower elongated member. The opening 130 may be round or have an oval shape. The sidewall 132 of the opening may include one or more grooves 134. In this embodiment. the sidewall of the opening includes two rectangular grooves spaced approximately 180° about the circumference of the sidewall 133.

As shown in FIGS. 18-24, the rear cover 20 may be configured and adapted to mate with the catch 54 and the chamber opening 130. and thus securely seal the storage chamber 18 that is disposed in the lower elongated member 26. The rear cover 20 may include a plug 50, a latch 132, and a rubber covering 134.

As shown in FIG. 20, the rear cover 20 further may include a rigid skeleton 136 and an over molded rubber covering 138. The rubber covering may be disposed on the outside of the cover so as to match the feel and appearance of the upper portion of the back plate.

Referring to FIGS. 18 and 19, the skeleton 136 may further include a rectangular recess 140. The sidewalls of rectangular recess may include ribs 128 that are configured and dimensioned to mate with the grooves 126 in the catch 54. The sidewalls may open to a housing 142 which contains a latching mechanism 144 that is located on the opposite side of the sidewalls. The latching mechanism 144 may include opposing clamping members 146, 148.

Referring to FIGS. 19-24, the clamping members 146, 148 may project into the recess 140 from the housing. Each clamping member may be integrally formed with a clamping block 150, 152. Each clamping member may include a stepped section 154, 156 adjacent to the clamping member of each respective clamping block. Additionally, each clamping block may include a lateral cutout 158, 160 and spring attachment site 162, 164. Each clamping member further may include a slot 170, 172 adjacent the base of each respective clamping block.

The clamping blocks may abut each other. Additionally, the blocks may interlock such that each clamping member rests on the upper surface of the stepped section of the other clamping block. A spring may be disposed between the lateral cutouts 158, 160 of each clamping block. One end of the spring 166 may be attached to the spring attachment site of one clamping block; and the other end of the spring may be attached to the spring attachment site of the other clamping block. The spring may be situated in the lateral cut out of each clamping block. Also, an elongated member 168 may be disposed in the slot of each clamping block such that the elongated member may limit movement of each clamping block.

Figure 21:
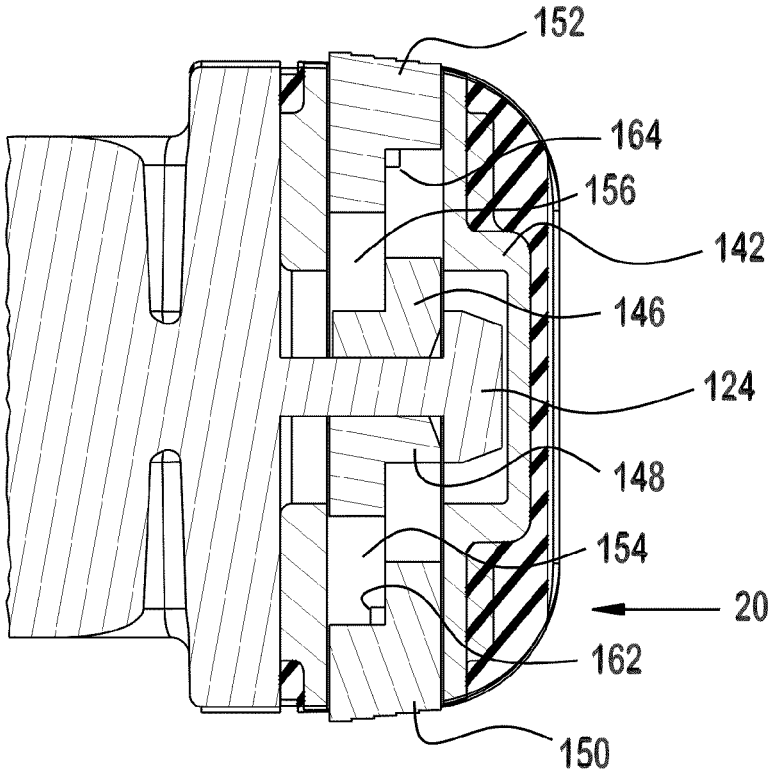
FIG. 21 is a horizontal cross section showing the catch and latches.
Figure 22:
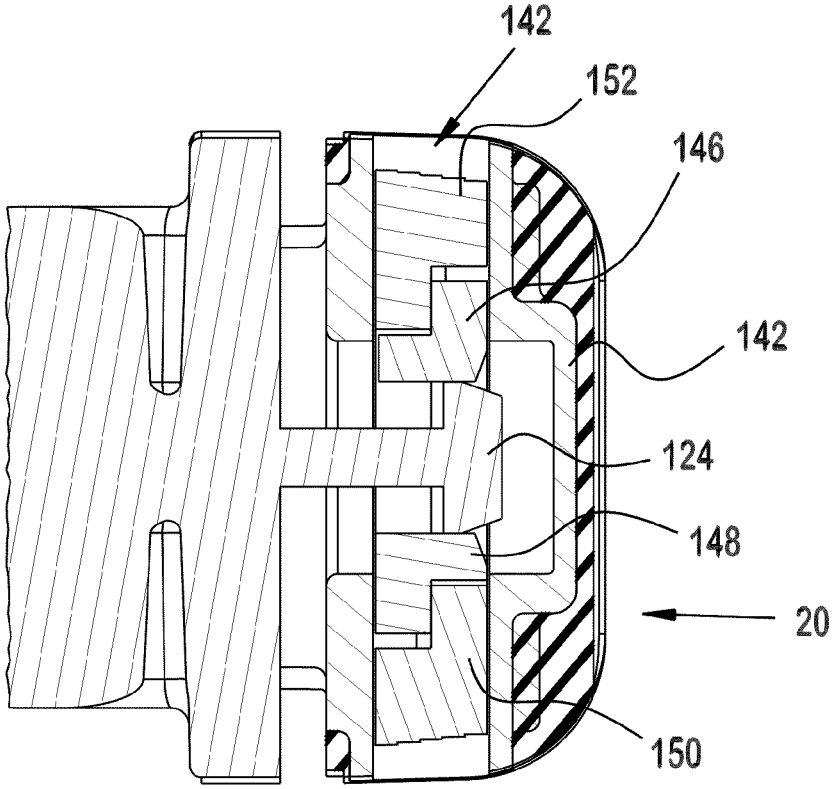
FIG. 22 is a horizontal cross section showing the catch with latches depressed to remove the plug.
Figure 23:
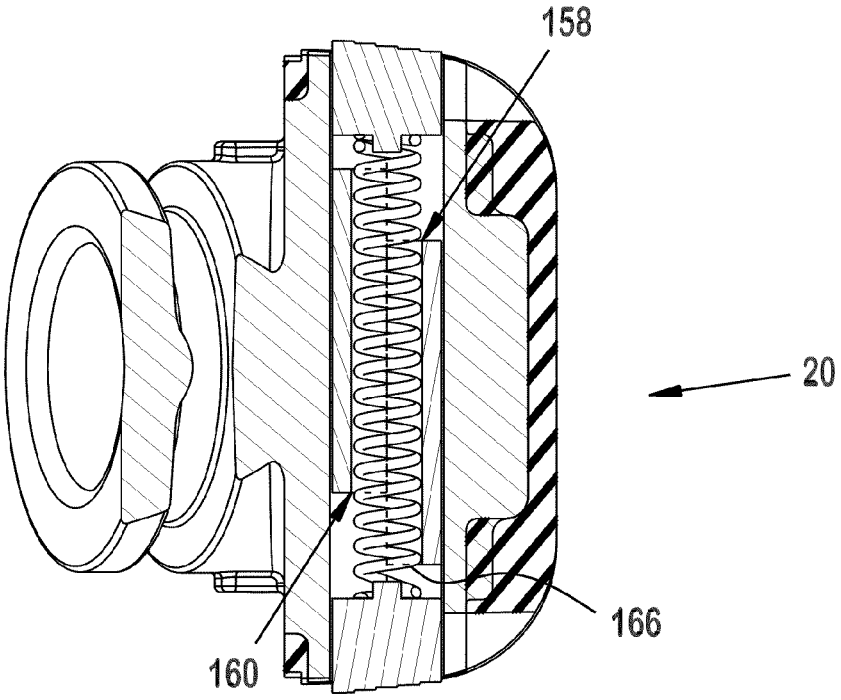
FIG. 23 is a horizontal cross section showing the spring biasing the latches to locked position.
Figure 24:
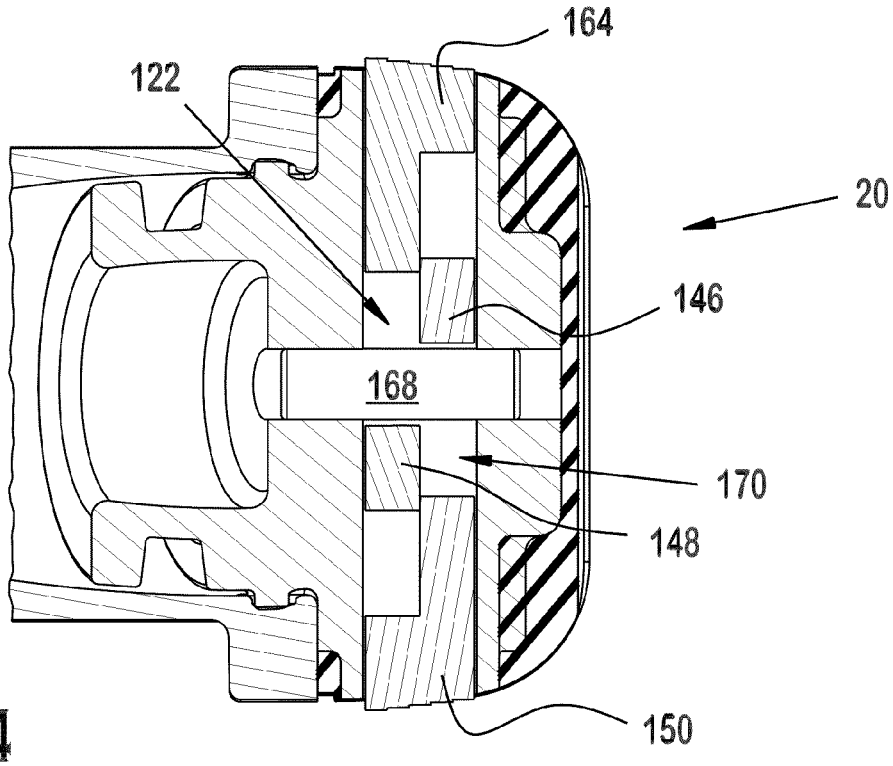
FIG. 24 is a horizontal cross section showing the pin that retains the latches in the body.
Figure 25:
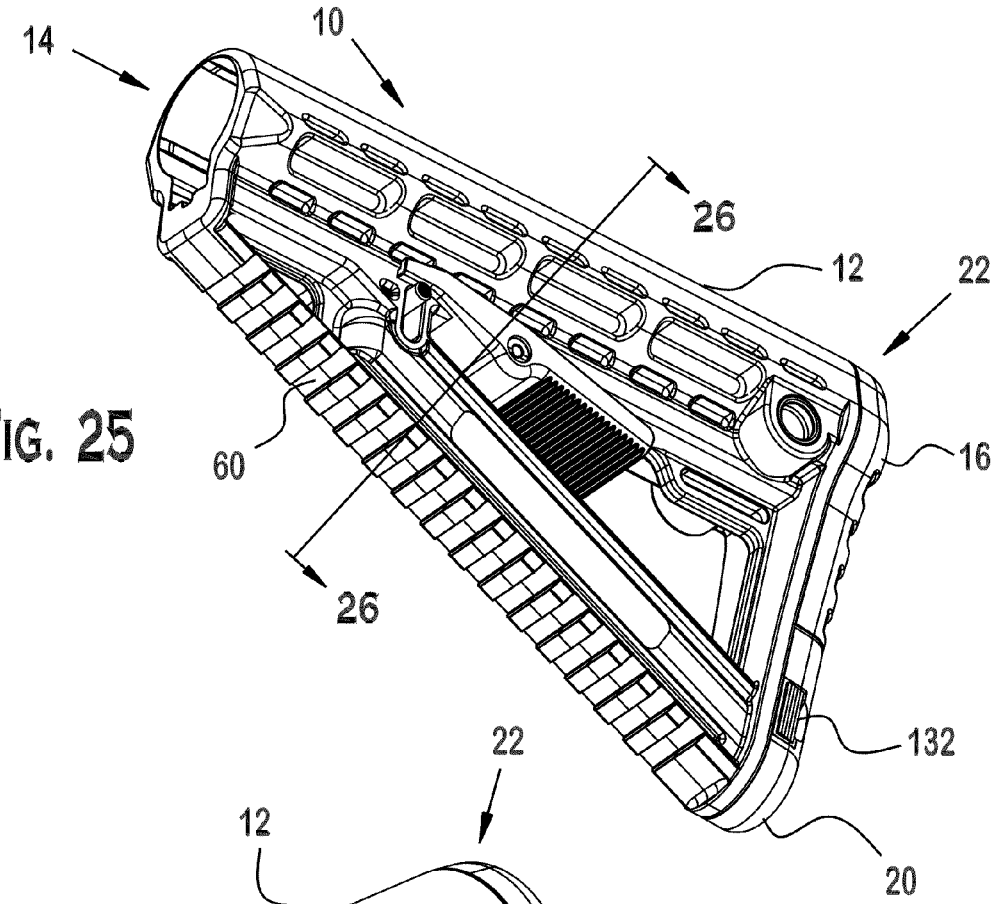
FIG. 25 is another perspective view of the rifle stock of FIG. 1 from the front bottom.
Figure 26:
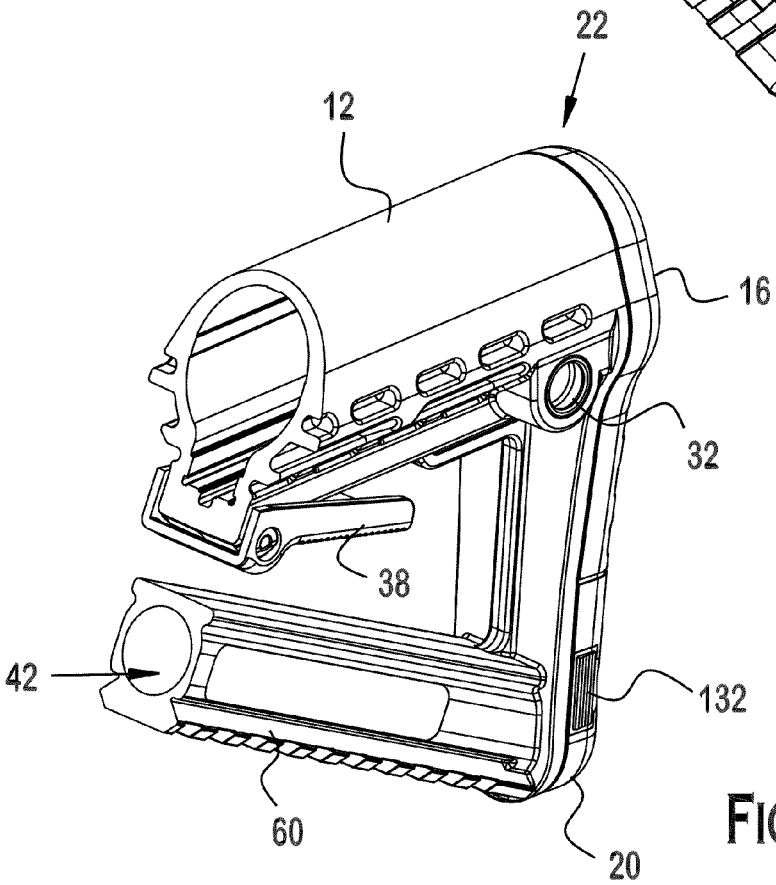
FIG. 26 is a perspective view from the front left of a cross-section of FIG. 25, along line 26-26.
Figure 27:
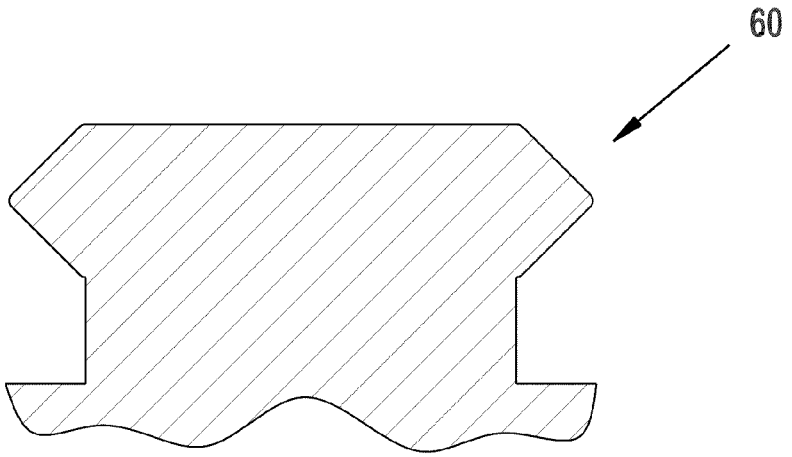
FIG. 27 is a schematic showing an accessory mounting rail profile that conforms to US Department of Defense Military Standard 1913.
Figure 28:
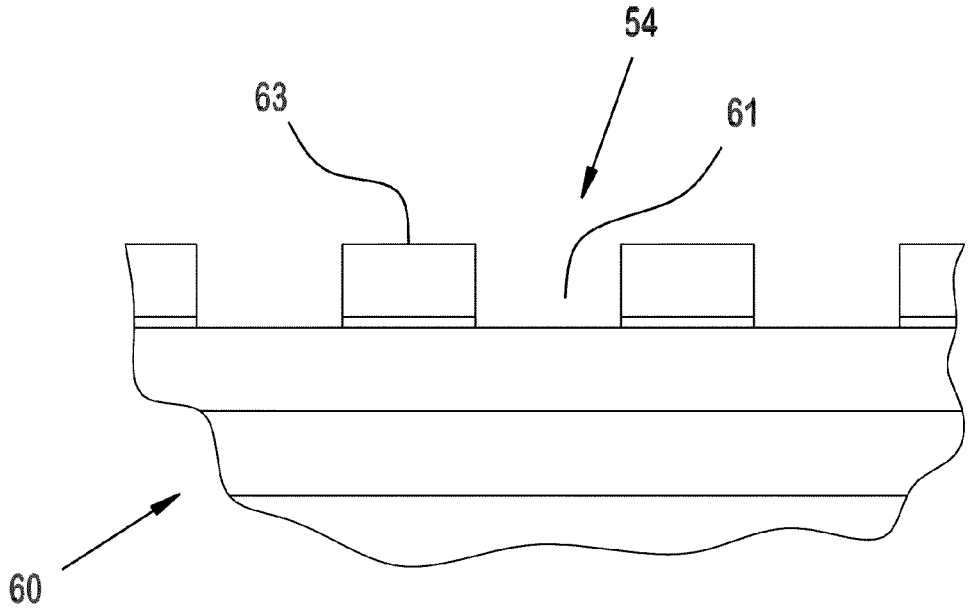
FIG. 28 is a schematic showing recoil groove dimensions that conform to US Department of Defense Military Standard 1913.

As shown in FIGS. 21 and 22, the clamping members 146, 148 may be operable from a clamped configuration (FIG. 21) in which the clamping members are narrowly spaced from each other, and a released configuration in which the distance separating the opposing clamping members increases from the clamped position. The clamping members 146, 148 may be biased in the clamped position (FIG. 21) by the spring. At the same time, the clamping members may be held within the housing by the elongated member.

Referring to FIGS. 21-24, the rear cover 20 may be attached to the catch 54 and storage compartment 42. The cover 20 may be placed near the catch 54 and storage compartment 42 so that the ribs 128 in the recess 140 of the rear cover are aligned with the recesses 126 within the catch. Additionally the plug 50 is aligned with the chamber 42. The rear cover 20 may then be connected to the catch 54 and storage compartment 42 by advancing the ribs 128 and plug 50 along an inclined axis that is aligned with the recesses 126 and storage compartment 42. The cover 20 is advanced until the ribs 128, and projections 170 adjacent the plug 50 are fully seated in their respective grooves 134 on the back plate 30 of the stock. Referring to FIG. 22, as the cover is seated on the rear end of the stock 22 a beveled T-shaped member 124 on the catch may press the clamping members 146, 148 apart and passes through them. After the head of the T-shaped member 128 passes between the clamping members, the clamping members return to their initial or closed position, as depicted in FIG. 21. The head of the T-shaped member being fully disposed within the latch. In particular, the head is disposed upon the far side of the clamping member heads and the stem is disposed between the clamping members. In this fashion, the rear cover may be secured to the catch with enhanced stability for the latch as these structures interact to prevent movement of the cover in three orthogonal directions.

Furthermore, the plug 50 may provide a friction fit with the cylindrical storage compartment to prevent unintended opening of the compartment, as well as increase the water resistance of the sealed compartment. In this manner, the cover 20 and the cover attachment mechanism 132 cooperate to prevent accidental opening of the compartment, as well as to securely seal the compartment from wet or humid conditions that may degrade the quality of stored batteries or other materials.

Referring to FIG. 22, the rear cover 20 may be removed from the stock 10 by squeezing the lateral tab 150, 152 of each clamping block. Each clamping block may be pressed inward toward each other. As the clamping blocks move toward each other, the clamping faces 146, 148 move away from the T-shaped catch. When the tabs 28 are each near fully depressed, the clamping members are spaced sufficiently apart to allow the T-shaped member 124 to exit the recess 142. In this configuration, the cover then may be withdrawn by pulling the rear cover away from the back plate area, along an axis oriented parallel to the longitudinal axis of the storage compartment. In this regard, the release of the T-shaped catch is dependent on sufficient lateral movement of both clamping members. Thus, the back plate area, latching mechanism, and the rear cover provide multiple contact points that prevent the unintended release or separation of the rear cover from the stock.

Referring to a weapon system accessory (not shown) may be mounted on the accessory mounting rail. For instance, night vision devices, suppressors, laser pointers, telescopic sights, bayonets, grips, monopods, bloods, or other devices which are compatible with an MIL-STD-1913 Picatinny rail may be attached directly to the accessory mounting rail.

Referring to FIGS. 2, 8 and 25-28, the mounting platform 60 may possess a wedge shaped cross section 172 and a plurality of recoil grooves 174. For instance, the profile of the accessory mounting rail and the dimensions and spacing of the recoil grooves may conform to military standards, such as MIL-STD-1913 published by the US Department of Defense on Feb. 3, 1995. Thus, the profile (or cross sectional outline) of the accessory mounting rail 60 and the dimensions and spacing of the recoil grooves 174 may conform to the outlines and dimensions which are depicted in MIL-STD-1913, and which are measured in inches.

In use, the preferred embodiment of the stock may be used to store spare batteries or other materials, parts and equipment in the sealed compartment. A user may open the compartment by squeezing tabs 25 simultaneously toward the vertical midline of the back plate. Once the tabs are depressed, the user may separate the cover from the latch (or attachment site) by pulling the cover away from the stock in a direction that is generally aligned with the horizontal members of the catch. After the latch and catch are separated, the user may remove the plug from the compartment by drawing the cover away from the stock along the longitudinal axis of the compartment to provide access to the storage space. By contrast, a user may close the compartment by squeezing tabs 25 simultaneously toward the vertical midline of the back plate to retract the clamping members of the catch, inserting the plug into the compartment and advancing the cover toward the stock along the longitudinal axis of the compartment to block access to the storage space, seating the cover onto the latch (or attachment site) by placing the recess and retracted lateral prongs about the attachment site, and releasing the tabs to bias the lateral prongs into engagement with the vertical and horizontal members of the attachment site.

Although the steps for opening the cover may be performed in a continuous manner, the sequence of steps deters unintended opening of the compartment because the vertical recess (or groove) on the cover cooperates with the vertical member of the attachment site to prevent rotation of the cover, the angled members of the attachment site cooperate with the catch (i.e., the spring loaded lateral prongs) to prevent rearward and downward movement of the cover, and the cylindrical plug and bore prevent movement out of alignment with the longitudinal axis of the compartment.

While it has been illustrated and described what at present are considered to be preferred embodiments of the present invention, it will be understood by those skilled in the art that various changes and modifications may be made, and equivalents may be substituted for elements thereof without departing from the true scope of the invention. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A stock for a small arms weapon comprising:

an upper frame member for receiving a receiver extension which comprises a distal end which comprises a receiver extension connection structure, a proximal end, and a first longitudinal axis extending between the proximal end and the distal end, and a first cross-sectional profile perpendicular to the first longitudinal axis which defines a maximum outer dimension of the stock; and a lower frame member connected to the upper frame member which comprises a third end adjacent to the proximal end, a fourth end spaced from the distal end, a second longitudinal axis extending between the third end and the fourth end, the first longitudinal axis and the second longitudinal axis being disposed at an acute angle, a storage chamber inside the lower frame member such that the chamber is configured and dimensioned to house a power supply for a small arms accessory, and a Picatinny rail aligned with the second longitudinal axis.

2. The stock of claim 1, further comprising a third member connecting the first member to the second member.

3. The stock of claim 2, wherein the third member includes a back plate attachment structure.

4. The stock of claim 3, further comprising a back plate which mates with the back plate attachment structure.

5. The stock of claim 4, wherein the stock further comprises a cover for the chamber such that the cover seals the chamber.

6. The stock of claim 5, wherein the cover comprises a recess, a resilient member, and a plug such that the recess mates with the back plate attachment structure, the resilient member interlocks with the attachment structure and the plug fills a portion of the chamber to seal the chamber.

7. The stock of claim 1, wherein the acute angle measures between about 20 degrees and about 30 degrees.

8. The stock of claim 7, wherein the acute angle measures about 30 degrees.

9. The stock of claim 8, wherein the stock has a maximum width of less than about 2.25 inches.

10. The stock of claim 1, wherein the stock has a maximum width of between 1.4 inches and 2.0 inches.

11. The stock of claim 10, wherein the stock has a maximum width of about 1.9 inches.

12. The stock of claim 1, wherein the chamber is configured and dimensioned to receive a plurality of batteries in series.

13. The stock of claim 12, wherein the chamber is configured and dimensioned to receive two CR123 batteries.

14. The stock of claim 12, wherein the chamber is configured and dimensioned to receive two AA batteries.

* * * * *